United States Patent [19]

Kajita et al.

[11] Patent Number: 4,697,911

[45] Date of Patent: Oct. 6, 1987

[54] ELECTROSTATIC COPYING APPARATUS

[75] Inventors: Hiroshi Kajita, Kobe; Koji Ujino, Osaka; Yoshiyuki Uehara, Yokohama, all of Japan

[73] Assignee: Mita Industrial Co., Ltd., Osaka, Japan

[21] Appl. No.: 783,635

[22] Filed: Oct. 3, 1985

[30] Foreign Application Priority Data

Oct. 5, 1984 [JP] Japan ..... 59-207940[U]
Oct. 17, 1984 [JP] Japan ..... 59-155854[U]
Apr. 30, 1985 [JP] Japan ..... 60-91127

[51] Int. Cl.[4] ..... G03G 21/00; B65H 5/06

[52] U.S. Cl. ..... 355/3 SH; 271/3.1; 271/245; 271/265; 355/14 SH

[58] Field of Search ..... 355/3 R, 3 SH, 14 SH, 355/23, 24, 25; 271/3.1, 163, 171, 238, 240, 245, 258, 265

[56] References Cited

U.S. PATENT DOCUMENTS

| | | | |
|---|---|---|---|
| 4,050,690 | 9/1977 | Michelson | 271/265 X |
| 4,089,516 | 5/1978 | Colglazier et al. | 271/9 |
| 4,113,245 | 9/1978 | Colglazier et al. | 271/10 |
| 4,171,129 | 10/1979 | Daley et al. | 271/245 X |
| 4,231,566 | 11/1980 | Suzuki | 271/171 X |
| 4,294,535 | 10/1981 | Ariyama et al. | 355/14 SH |
| 4,385,825 | 5/1983 | Kaneko | 355/3 SH |
| 4,403,851 | 9/1983 | Yanagawa | 355/14 R |
| 4,428,667 | 1/1984 | Phelps et al. | 271/245 X |
| 4,453,819 | 6/1984 | Wada et al. | 355/3 SH |
| 4,459,013 | 7/1984 | Hamlin et al. | 355/23 |
| 4,474,453 | 10/1984 | Yanagawa et al. | 355/14 R X |
| 4,478,405 | 10/1984 | Eertink et al. | 355/14 SH X |

*Primary Examiner*—Fred L. Braun

*Attorney, Agent, or Firm*—Wenderoth, Lind & Ponack

[57] ABSTRACT

An electrostatic copying apparatus conveys a copying paper sheet through a copying paper conveying passage thereby to form an image on one surface of the sheet, selectively introduces it into a copying paper returning passage, returns it to a copying paper re-sending device through the returning passage, and again feeds it into the paper conveying passage from the re-sending device so as to form an image on the other surface of the paper sheet. The paper re-sending device includes a copying paper receiving stand for receiving copying paper sheets and a delivery device disposed above the receiving stand. The delivery device is selectively maintained in a non-operating state in which it moves away from the copying paper received on the receiving stand, a first operating state in which it acts relatively weakly on the copying paper received on the receiving stand, and a second operating state at which it acts relatively strongly on the copying paper received on the receiving stand. A mechanism prevents feeding of papers in the superposed state, and a copying paper detecting mechanism, applicable to various types of electrostatic copying apparatus, permits effective detection of the arrival of a copying paper at the paper re-sending device.

28 Claims, 19 Drawing Figures

ELECTROSTATIC COPYING APPARATUS

BACKGROUND OF THE INVENTION

1. Field of the Invention

This invention relates to an improvement in and relating to various elements of an electrostatic copying apparatus.

2. Description of the Prior Art

As document copying has been diversified in recent years, an electrostatic copying apparatus of the type capable of forming a copied image on both surfaces of a copying paper sheet has been proposed and come into commercial acceptance. This type of electrostatic copying apparatus, as is well known to those skilled in the art, comprises a copying paper conveying passage, a copying paper feeding means for feeding copying paper to the copying paper conveying passage, a copying paper returning passage, and a copying paper re-sending means for receiving the copying paper sheet returned through the copying paper returning passage and re-sending the received copying paper sheet to the copying paper conveying passage, and is adapted to form a copied image on both surfaces of the copying paper sheet in the following manner. The copying paper sheet fed to the paper conveying passage from the paper feeding means is conveyed through the paper conveying passage and during this conveyance, an image is formed on one surface of the paper sheet. The paper sheet having the image formed on its one surface is then selectively introduced into the paper returning passage and sent to the paper re-sending means. The paper sheet thus received in the paper re-sending means is re-sent to the paper conveying passage by the action of the paper re-sending means. While it is again conveyed through the paper conveying passage, an image is formed on the other surface of the copying paper sheet. As a result, the desired images are formed on both surfaces of the copying paper sheet fed from the paper feeding means.

The aforesaid type of electrostatic copying apparatus known in the art has the following inconveniences or defects.

Firstly, the paper returning means usually includes a copying paper receiving stand for receiving copying paper sheets returned through the paper returning passage. To receive the copying paper sheets in the desired stacked state on the paper receiving stand, the copying paper sheets should be conveyed with a relatively weak sending force. On the other hand, in order to send the uppermost sheet of the stack received on the paper receiving stand toward the paper conveying passage, it should be delivered with a relatively strong sending force. In the conventional electrostatic copying apparatus of this type, the paper returning means further includes auxiliary conveying rollers for receiving the copying paper sheets on the paper receiving stand in the desired conditions (these auxiliary conveying rollers act relatively weakly on the copying paper sheet and convey it) and delivery rollers for delivering the copying paper sheet from the paper receiving stand (the delivery rollers act relatively strongly on the copying paper sheet and deliver it), and is constructed such that the auxiliary conveying rollers and the delivery rollers are each selectively held in an operating state in which they act on the copying paper sheet and in a non-operating state in which they are apart from the copying paper sheet. Specifically, it is of such a construction that when the copying paper sheet is received by the receiving stand, the auxiliary conveying rollers are maintained in the operating state and the delivery rollers are maintained in the non-operating state; that when the position of the copying paper sheet in the width direction is set, the auxiliary conveying rollers and the delivery rollers are both kept in the non-operating states; and that when the copying paper sheet is delivered from the receiving stand, the auxiliary conveying rollers are maintained in the non-operating state and the delivery rollers are maintained in the operating state. Thus, in the conventional electrostatic copying apparatus, the auxiliary conveying rollers and the delivery rollers exist independently, and a mechanism is required which selectively maintains the auxiliary conveying rollers and the delivery rollers in the operating states and in the non-operating states. Accordingly, the structure and controlling of the paper re-sending means become complex.

Secondly, in an electrostatic copying apparatus not necessarily limited to the above-described type, a mechanism for preventing the conveying of copying paper sheets in superposed state is well known in order to accurately feed copying paper sheets one by one from the stack. This mechanism is composed of a combination of a conveying roller to be rotated in a predetermined direction and a frictional member to be in pressing contact with the peripheral surface of the conveying roller. This conventional preventing mechanism is of such a structure that the frictional member is always in pressing contact with the peripheral surface of the conveying roller. The frictional member is therefore worn within a relatively short period of time and the aforesaid preventing function of the preventing mechanism will be reduced. As a result, the copying paper sheets cannot be fed accurately one by one.

Thirdly, electrostatic copying apparatuses, not necessarily limited to the above-described type, include a copying paper detecting mechanism for detecting a copying paper sheet conveyed through the paper conveying passage, etc. in order to detect paper jamming in the paper conveying passage or elsewhere. This type of paper detecting mechanism known in the art generally includes a detecting means comprising a combination of a microswitch or light emitting element and a light-receiving element and is constructed such that the detecting means directly detects passage of the copying paper sheet. For example, to detect paper jamming in the paper returning passage of the aforesaid type of electrostatic copying apparatus, it is necessary to annex a copying paper detecting mechanism to the paper receiving stand in relation to the paper returning means and to detect the arrival of the copying paper sheet. However, the conventional paper detecting mechanism can detect the first sheet of the paper stack, but cannot detect the second subsequent sheets because the copying paper sheets are stacked on the receiving stand.

SUMMARY OF THE INVENTION

It is a first object of this invention to provide an electrostatic copying apparatus which can permit feeding of a copying paper sheet returned through a paper returning passage to a paper conveying passage in the desired manner by a relatively simple structure and a relatively simple and easy controlling operation.

A second object of this invention is to provide a mechanism for preventing feeding of copying paper sheets in the superposed state, which exhibits its preventing function over a long period of time while inhibiting wearing of a frictional member.

A third object of this invention is to provide a copying paper detecting mechanism which can accurately detect the arrival of a copying paper sheet at a copying paper receiving stand on which copying paper sheets are received in the stacked state.

A fourth object of this invention is to provide an electrostatic copying apparatus, particularly one capable of forming an image on both surfaces of a copying paper sheet, which can accurately detect the arrival of a copying paper sheet returned through a copying paper returning passage at a copying paper re-sending means.

Other objects of this invention will become apparent from the following description.

To achieve the first object, the present invention provides an electrostatic copying apparatus adapted to introduce selectively a copying paper sheet having an image formed on one surface thereof during conveyance through a copying paper conveying passage into a copying paper returning passage, return the copying paper sheet through the paper returning passage to a copying paper re-sending means disposed below the paper returning passage, and to feed it again to the paper conveying passage from the re-sending means in order to form an image on the other surface, said re-sending means including a copying paper receiving stand for receiving copying paper sheets having an image formed on one surface in the stacked state, a width matching means for matching the widthwise positions of the copying paper sheets received on the paper receiving stand, and a delivery means disposed above the paper receiving stand; wherein said paper re-sending means further includes an actuating mechanism for maintaining said delivery means selectively in a non-operating state in which it is kept apart from a copying paper sheet received on the paper receiving stand, in a first operating state in which it acts relatively weakly on said copying paper sheet, and in a second operating state in which it acts relatively strongly on said copying paper sheet, and said actuating mechanism maintains the delivery means in the first operating state when the copying paper sheet having an image formed on one surface is received on the paper receiving stand through the returning passage, in the non-operating state when the widthwise positions of the copying paper sheets received on the receiving stand are matched, and in the second operating state when the copying paper sheet received on the paper receiving stand is delivered toward the paper conveying passage.

To achieve the second object, the present invention provides a mechanism for preventing feeding of copying paper sheets in the superposed state, comprising a conveying roller to be rotated in a predetermined direction, a frictional member and a pressing mechanism for moving the frictional member, said pressing mechanism being adapted to maintain the frictional member selectively in an operating state in which it acts on the peripheral surface of the conveying roller and in a non-operating state in which it moves away from the conveying roller.

To achieve the third object, the present invention further provides a copying paper detecting mechanism comprising a supporting member disposed vertically movably above a copying paper receiving stand for receiving copying paper sheets in the stacked state, a follower roller mounted rotatably on the supporting member and adapted to roll by the action of a copying paper sheet conveyed to the paper receiving stand and a detecting means for detecting the rolling of the follower roller.

To achieve the fourth object, the present invention provides an electrostatic copying apparatus comprising a copying paper conveying means defining a copying paper conveying passage, a copying paper feeding means for feeding a copying paper sheet to the paper conveying passage, a copying paper returning means defining a copying paper returning passage, a copying paper re-feeding means defining a copying paper re-feeding passage, and a copying paper re-sending means for receiving a copying paper sheet returned through the paper returning passage and re-sending it to the paper conveying passage through the paper re-feeding passage, said apparatus being adapted to feed a copying paper sheet to the paper conveying passage from the paper feeding means, convey it through the paper conveying passage to form an image on one surface of the sheet during conveyance through the conveying passage, selectively introduce the copying paper sheet having an image formed on one surface into the paper returning passage, return the copying paper sheet through the paper returning passage to the paper re-sending means, re-feed the copying paper sheet through the paper re-feeding passage from the paper re-sending means to the paper conveying passage, and re-convey the copying paper sheet through the paper conveying passage to form an image on its other surface during the re-conveyance; wherein the paper re-sending means includes a copying paper receiving stand for receiving in the stacked state copying paper sheets returned through the paper returning passage, a width matching means for matching the widthwise positions of the copying paper sheets received on the paper receiving stand, and a copying paper detecting means for detecting the copying paper sheet, the width matching means includes at least one movable matching member movable between a receiving position at which the copying papers are received and a matching position at which the widthwise positions of the copying paper sheets are matched, the copying paper detecting means is mounted on the movable matching member, and the paper returning means further includes a deflecting-conveying means for conveying in the deflected state the copying paper sheet, which is to be returned toward the paper re-sending means, toward the movable matching member on which the paper detecting means is mounted.

DETAILED DESCRIPTION OF PREFERRED EMBODIMENTS

The invention will now be described in detail with reference to the accompanying drawings.

Outline of the General Structure and Operation of the Electrostatic Copying Apparatus First of all, the general structure of one embodiment of an electrostatic copying apparatus on which various improvements have been made in accordance with this invention will be described.

Figure 1:
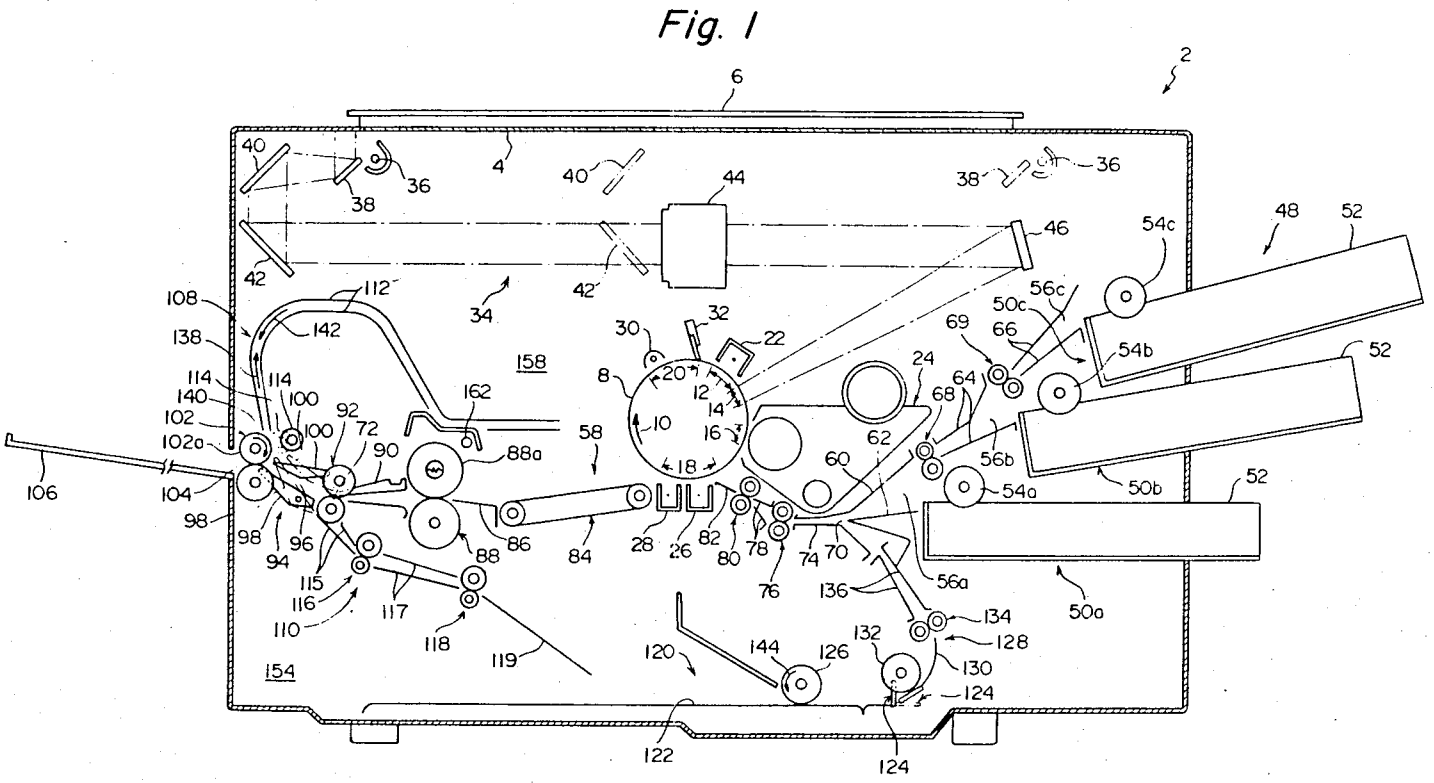
FIG. 1 is a sectional view which shows in a simplified form the main constituent elements of an electrostatic copying apparatus improved in various respects in accordance with the present invention.

With reference to FIG. 1, the illustrated electrostatic copying apparatus includes a nearly rectangular housing 2. A stationary transparent plate 4 on which to place a document (not shown) to be copied and an openable document holding member 6 for covering the transparent plate 4 and the document to be placed on it are disposed on the top surface of the housing 2.

A rotating drum 8 having an electrostatographic material on its peripheral surface is rotatably mounted nearly centrally within the housing 2. Around the rotating drum 8 to be rotated in the direction shown by an arrow 10 are defined a charging zone 12, an exposing zone 14, a developing zone 16, a transferring zone 18 and a cleaning zone 20 defined in this order in the direction of the arrow 10. A charging corona discharge device 22 is disposed in the charging zone, and a developing device 24 is disposed in the developing zone 16. A transferring corona discharge device 26 and a peeling corona discharge device 28 are provided in the transferring zone 18. In the cleaning zone 20 are positioned a charge eliminating lamp 30 and a residual toner removing blade 32.

An optical system shown generally at 34 is provided above the rotating drum 8. The optical system 34 comprises a movable document illuminating lamp 36, a first movable reflecting mirror 38, a second movable reflecting mirror 40, a third movable reflecting mirror 42, a stationary lens assembly 44 and a stationary reflecting mirror 46. During scanning exposure, the movable document illuminating lamp 36 and the first movable reflecting mirror 38 are moved at a predetermined speed V from a start-of-scan position shown by solid lines to a desired position (for example, a maximum end-of-scan position shown by two-dot chain lines) substantially horizontally. The second movable reflecting mirror 40 and the third movable reflecting mirror 42 are moved at a speed half of the above predetermined speed (V/2) from a start-of-scan position shown by solidline to a desired position (for example, a maximum end-of-scan position shown by two-dot chain lines) substantially horizontally.

During this action, the document placed on the transparent plate 4 is illuminated by the document illuminating lamp 36, and the light reflected from the document is reflected successively by the first, second and third reflecting mirors 38, 40 and 42 reaches the lens assembly 44. Then it is reflected by the stationary reflecting mirror 46 and projected onto the electrostatographic material in the exposing zone 14. When the scanning exposure is over, the movable document illuminating lamp 36 and the first, second and third reflecting mirrors 38, 40 and 42 are returned to the start-of-scan positions shown by the solid lines.

In one end portion (the right end portion in FIG. 1) of the housing 2, a copying paper feeding means shown generally at 48 is provided. The paper feeding means 48 includes a lower cassette receiving section 50*a*, an intermediate cassette receiving section 50*b* and an upper cassette receiving section 50*c* for selectively and detachably receiving several types of copying paper cassettes 52 containing copying paper sheets of different sizes. Delivery rollers 54*a*, 54*b* and 54*c* for delivering the copying paper sheets one by one from the paper cassettes 52 are provided respectively in the lower, intermediate and upper cassette receiving sections 50*a*, 50*b* and 50*c*. The copying paper delivered from the paper cassette 52 mounted on the lower cassette receiving section 50*a* is introduced into a copying paper conveying passage generally shown at 58 through a copying paper delivery passage 56*a*. The copying paper delivered from the paper cassette 52 mounted on the intermediate cassette receiving section 50*b* is introduced into the paper conveying passage 58 through the paper delivery passages 56*b* and 56*a*. The copying paper delivered from the paper cassette 52 mounted on the upper cassette receiving section 50*c* is introduced into the paper conveying passage 58 through a copying paper delivery passage 56*c* and the paper delivery passages 56*b* and 56*a*. The paper delivery passage 56*a* is defined by the upstream portion of a guide plate 60 and a part of a guide plate 62. The paper delivery passage 56*b* is defined by a pair of guide plates 64. The paper delivery passage 56*c* is defined by a pair of guide plates 66. A pair of delivery rollers 68 are disposed between the upstream end of the paper delivery passage 56*a* and the downstream end of the paper delivery passage 56*b*, and a pair of delivery rollers 69 are disposed between the upstream end of the paper delivery passage 56*b* and the downstream end of the paper feed passage 56*c*.

The paper conveying passage 58 extends nearly horizontally from right to left in FIG. 1 from its upstream end 70 to its downstream end 72, and is defined by a copying paper conveying means, specifically by the downstream portion of the guide plate 60, the downstream portion of a guide plate 74, a pair of conveying rollers 76, a pair of guide plates 78, a pair of conveying rollers 80, a guide plate 82, the transferring zone 18 (an area between the rotating drum 8 and the transferring corona discharge device 26 and the peeling corona discharge device 28), a conveyer belt mechanism 84, a guide plate 86, a pair of heat-fixing rollers 88, a pair of guide plates 90 and a pair of conveying rollers 92 in the illustrated embodiment.

A conveyance controlling means 94 is disposed adjacent to the downstream end 72 of the paper conveying passage 58. The conveyance controlling means 94 includes a lower movable guide member 98 and an upper movable guide member 100 defining therebetween a copying paper moving passage 96. The lower movable guide member 98 and the upper movable guide member 100 are selectively held at a lowered position shown by solid lines and at an elevated position shown by two-dot chain lines. Downstream of the conveyance controlling means 94 is provided a copying paper discharging passage 104 having a pair of discharge rollers 102. A receiving tray 106 is mounted detachably at the other end (i.e., the left end portion in FIG. 1) of the housing 2.

In relation to the conveyance controlling means 94, a copying paper reversing passage shown generally at 108 and a copying paper returning passage shown generally at 110 are provided. The paper reversing passage 108 is defined by a pair of guide plates 112 and extends in a curved shape from its upstream end adjacent to the downstream end of the conveyance controlling means 94. At the upstream end of the paper reversing passage 108 is disposed a reversing roller 114 adapted to be held selectively at a non-operating position shown by solid lines and an operating position shown by two-dot chain lines. The paper returning passage 110 extends inclined somewhat in a downward direction from left to right in FIG. 1 from its upstream end adjacent to the upstream end of the conveyance controlling means 94, and is defined by a copying paper returning means, specifically by a pair of guide plates 115, a pair of returning rollers 116, a pair of guide plates 117, a pair of returning rollers 118 and a guide plate 119 in the illustrated embodiment.

It will be readily understood from FIG. 1 that when the lower movable guide member 98 and the upper movable guide member 100 of the conveyance controlling means 94 are held at the lowered positions shown by solid lines, the paper conveying passage 58 and the paper discharge passage 104 are brought into communication with each other through the paper moving passage 96 in the conveyance controlling means 94. On the other hand, when the lower and upper movable guide members 98 and 100 are held at the elevated positions shown by two-dot chain lines, the paper conveying passage 58 and the paper reversing passage 108 are brought into communication with each other through the paper moving passage 96 of the controlling means 94 and at the same time, the paper reversing passage 108 and the paper returning passage 110 are brought into communication with each other through the moving passage 96 of the controlling means 94.

The illustrated electrostatic copying apparatus further includes a copying paper re-sending means shown generally at 120 below the paper returning passage 110. The paper re-sending means 120 includes a substantially horizontally extending stand 122 for receiving copying paper, and a movement hampering means 124 for hampering the movement of the copying paper is provided at the front end (i.e., the right end in FIG. 1) of the paper receiving stand 122. The movement hampering means 124 is adapted to be selectively held at a hampering position shown by solid lines and a receding position shown by two-dot chain lines. A delivery roller 126 is provided on the front end portion of the receiving stand 122. The delivery roller 126 is mounted so that it can freely move upwardly from its illustrated position contacting the upper surface of the paper receiving stand 122. Normally, the roller 126 is forced downwardly by a biasing action attributed to its own weight (or if required, by using a suitable spring means).

A copying paper re-feeding passage shown generally at 128 is provided which extends from the front end of the paper re-sending means 120 to the upstream end 70 of the paper conveying passage 58. The paper re-feeding passage 128 is defined by a copying paper re-feeding means, specifically by a guide plate 130, a conveying roller 132 which also performs a paper separating action in cooperation with a frictional member to be described hereinafter, a pair of re-feeding rollers 134, a pair of guide plates 136 and the upstream portion of the guide plate 74.

The operation of the electrostatic copying apparatus described hereinabove is now described.

The rotating drum 8 is rotated in the direction of the arrow 10. In the charging zone 12, the surface of the electrostatographic material on the rotating drum 8 is charged to a specific polarity by the charging corona discharge device 26, and in the exposing zone 14, the image of a document placed on the transparent plate 4 is scanned, exposed and projected onto the electrostatographic material by the optical system 34 to form a latent electrostatic image on the electrostatographic material. In the developing zone 16, a toner is applied to the latent electrostatic image on the electrostatographic material by the developing device 24 to develop the latent electrostatic image to a toner image. In the transferring zone 18, a copying paper sheet conveyed through the transferring zone 18 (the conveying of copying paper will be further described hereinbelow) is brought into contact with the surface of the electrostatographic material, and by the action of the transferring corona discharge device 26, the toner image on the electrostatographic material is transferred to the copying paper sheet. Thereafter, the copying paper is peeled from the electrostatographic material by the action of the peeling corona discharge device 28. The peeled copying paper is conveyed to the pair of heat-fixing rollers 88, and during passage between the rollers 88, the toner image is fixed to the copying paper. In the meantime, in the cleaning zone 20, light from the charge eliminating lamp 30 is illuminated onto the electrostatographic material to erase the residual charge thereon. The residual toner is removed from the surface of the electrostatographic material by the action of residual toner blade 32.

The conveying of copying paper will now be described. First, with reference to the formation of an image only on one surface of a copying paper, the lower and upper movable guide members 98 and 100 of the conveyance controlling means 94 are held at the lowered positions shown by solid lines. A copying paper sheet introduced into the paper conveying passage 58 from the paper cassette 52 loaded into the lower cassette receiving section 50*a*, the intermediate cassette receiving section 50*b* or the upper cassette receiving section 50*c* is conveyed through the conveying passage 58. During this time, a toner image is transferred to the upper surface of the copying paper in the transferring zone 18, and the toner image is fixed to that surface of the copying paper by the action of the pair of heat-fixing rollers 88. As a result, an image is formed on one surface of the copying paper. The copying paper having an image formed on one surface is then introduced into the paper discharge passage 104 through the paper moving passage 96 in the conveyance controlling means 94, and discharged into the receiving tray 106 through the paper discharge passage 104. Thus, a copy having an image formed on its one surface is obtained.

When an image is to be formed on both surfaces of copying paper, the lower and upper movable guide members 98 and 100 of the conveyance controlling means 94 are first held at the elevated positions shown by the two-dot chain lines. When the copying process is started, a copying paper introduced into the paper conveying passage from the paper cassette 52 loaded into the lower cassette receiving section 50*a*, the intermediate cassette-receiving section 50*b* or the upper cassette receiving section 50*c* is conveyed through the paper conveying passage 58. During this time, a toner image is transferred to one surface (the upper surface) of the copying paper in the transfering zone 18, and fixed onto one surface of the copying paper by the action of the heat-fixing rollers 88 to form an image on one surface of the copying paper. The copying paper from the paper conveying passage 58 is introduced into the paper reversing passage 108 through the paper moving passage 96 in the conveyance controlling means 94, and advances in the direction shown by an arrow 138 through the paper reversing passage 108. At this time, the under surface of the copying paper makes contact with one (102*a*) of the pair of discharge rollers 102. But since slippage is created between the discharge roller 102*a* and the copying paper, the copying paper can advance in the direction of arrow 138 in spite of the roller 102*a* being rotated in the direction of an arrow 140. When the trailing end of the copying paper has gone past the downstream end of the paper conveying passage 58, i.e. the nipping position of the pair of conveying rollers 92, the reversing roller 114 provided at the upstream end of the reversing passage 108 is held at the operating position shown by the two-dot chain lines so that the copying paper is pushed against the discharge roller 102*a*. As a result, the trailing and leading ends of the copying paper are reversed by the action of the discharge roller 102*a* rotating in the direction of arrow 140, and the copying paper advances in the direction shown by an arrow 142. It is passed through one of the pair of conveying rollers 92 (the lower roller 92 in FIG. 1) rotated in the counterclockwise direction as shown in FIG. 1 and one of the pair of guide plates 116, (the left plate 116 shown in FIG. 1) and is introduced into the paper returning passage 110 through which it advances. The reversing roller 114 in the paper reversing passage 108 is returned to the non-operating position shown by the solid lines at a suitable time after the copying paper has been introduced into the paper returning passage 110.

The copying paper advanced through the paper returning passage 110 is conducted to the paper receiving stand 122 of the paper re-sending means 120 and advances on the receiving stand 122 to the right in FIG. 1. The delivery roller 126 rotated in the direction shown by an arrow 144 acts on the copying paper to deliver it further to the right and thus cause the leading edge of the copying paper to abut against the movement hampering means 124 held at the hampering position shown by the solid lines. This hampers the advancing of the copying paper, and the copying paper is stopped at a desired position on the paper re-sending means 120. Even when the delivery roller 126 is rotated in the direction of the arrow 144, slippage is created between the delivery roller 126 and the copying paper, and there is no further advancing of the copying paper.

When a predetermined number of copying paper sheets have been returned to the paper re-sending means 120, the lower and upper movable guide members 98 and 100 of the conveyance controlling means 94 are returned to the lowered positions shown by the solid lines. The movement hampering means 124 in the paper re-sending means 120 is held at the receding position shown by the two-dot chain lines, and by the action of the delivery roller 126 rotating in the direction of the arrow 144, the copying paper is delivered from the paper re-sending means 120 to the paper re-feeding passage 128. The copying paper sheets delivered to the paper re-feeding passage 128 are caused to advance one by one through the paper re-feeding passage 128 and again are fed to the copying paper conveying passage 58. As can be easily understood from FIG. 1, the copying paper is reversed as a result of passing through the nearly semicircular paper re-feeding passage and is fed to the paper conveying passage 58 with its image-bearing surface down. It is then conveyed through the paper conveying passage 58. At this time, a toner image is transferred to the other surface of the copying paper (i.e. the upper surface) in the transferring zone 18, and fixed to the copying paper by the action of the pair of heat-fixing rollers 88. As a result, an image is formed on the other surface of the copying paper. Thereafter, the copying paper is introduced from the paper conveying passage 58 into the paper discharging passage 104 through the paper moving passage 96 in the conveyance controlling means 94, and discharged onto the receiving tray 106 through the paper discharge passage 104. Thus, a copy having an image formed on both surfaces is obtained.

The structure and operation described above of the illustrated electrostatic copying apparatus do not constitute novel features improved in accordance with the present invention, but merely illustrate one example of electrostatic copying apparatus to which the present invention is applicable. Hence, a detailed description of these will be omitted in the present specification.

Structure of the paper re-sending means and its vicinity

Now, the structure of the paper re-sending means 120 improved in accordance with this invention will be described.

Figure 2:
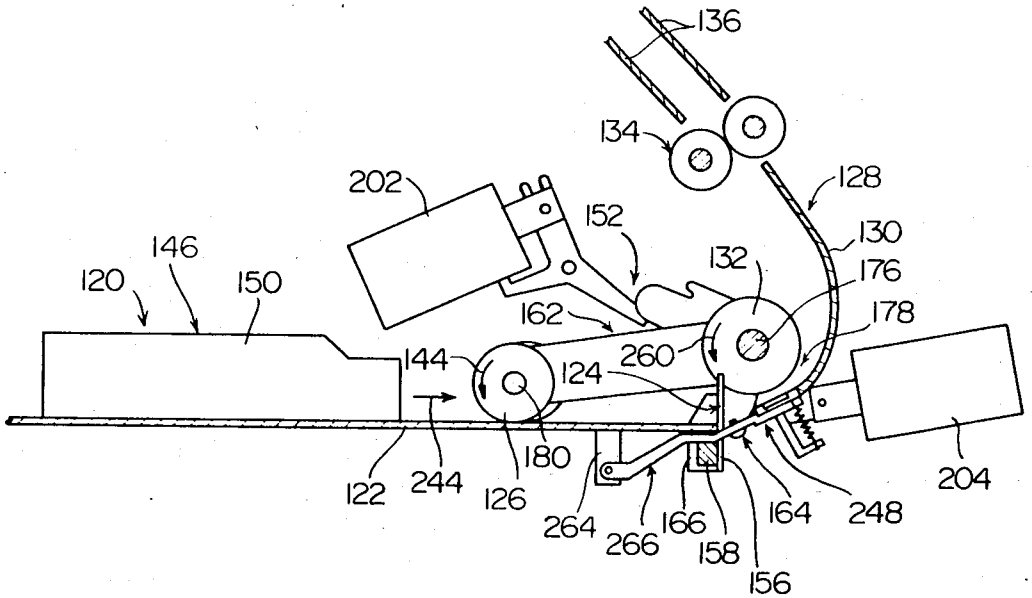
FIG. 2 is a sectional view showing a copying paper re-sending means and its vicinity in the electrostatic copying apparatus of FIG. 1.
Figure 3:
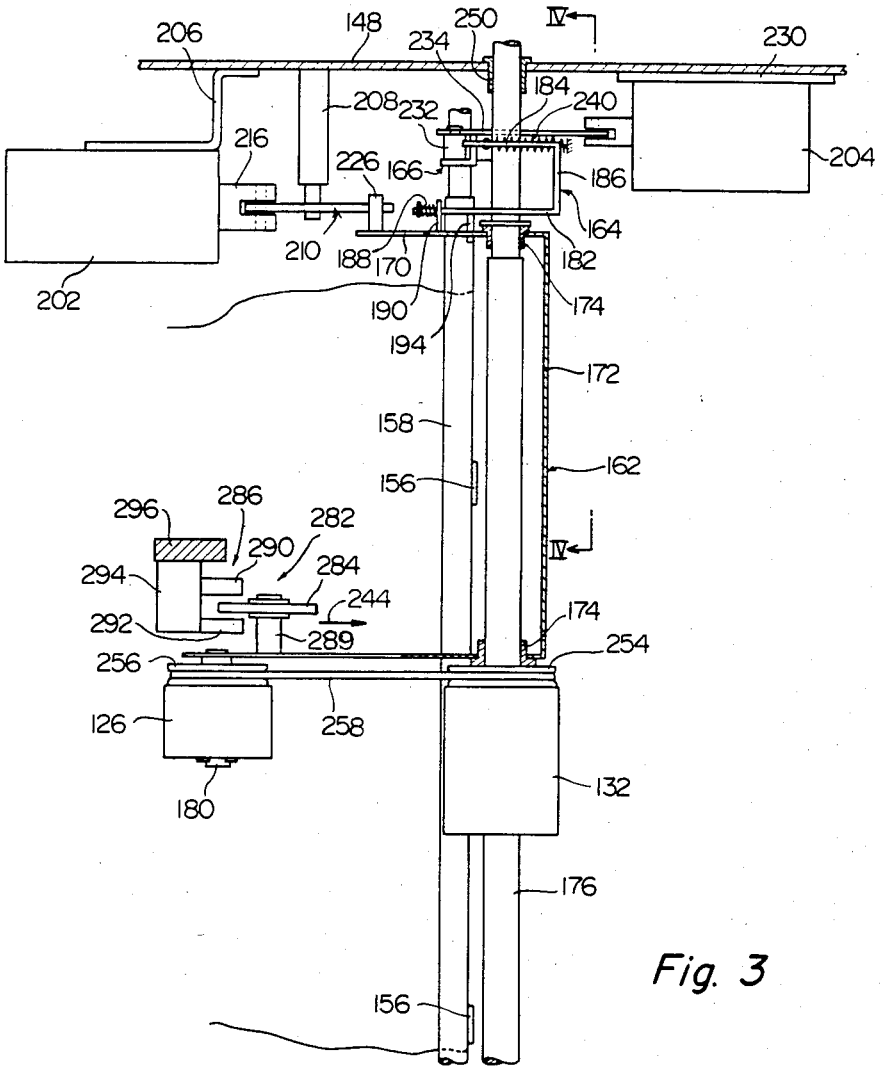
FIG. 3 is a top plan view showing the paper re-sending means of FIG. 2 partly in section.
Figure 4:
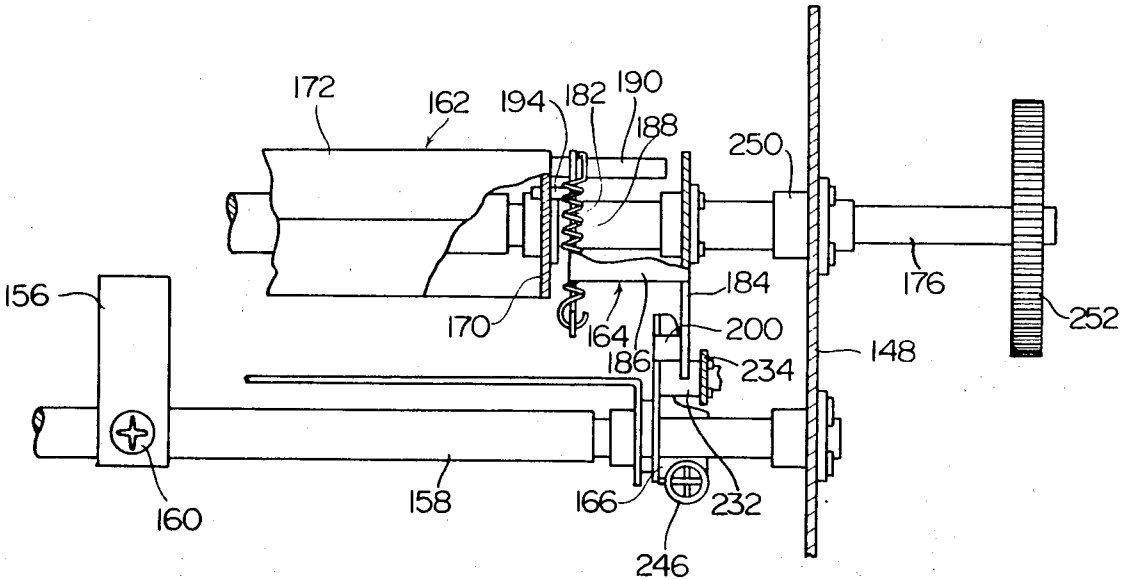
FIG. 4 is a sectional view taken along line IV—IV of FIG. 3.
Figure 5:
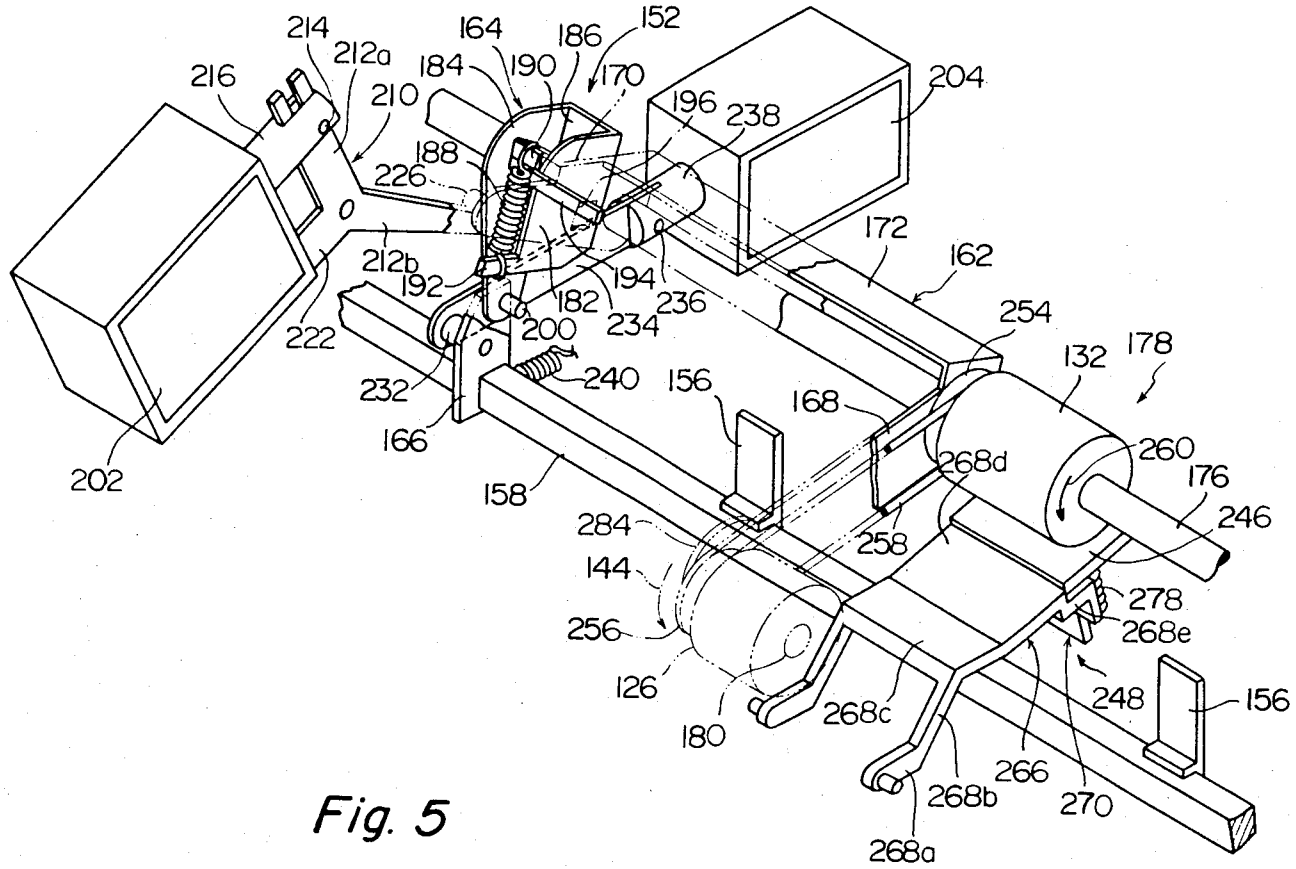
FIG. 5 is a perspective view, partly broken away, of the front portion of the paper re-sending means of FIG. 3.

With reference to FIGS. 2 and 3 together with FIG. 1, the paper re-sending means 120 in the illustrated embodiment includes the copying paper receiving stand 122 adapted to receive copying paper sheets returned through the paper returning passage 110, the delivery roller 126 (constituting delivery means) disposed above the paper receiving stand 122, and a width matching means 146 for matching the widthwise positions of the paper sheets received on the paper receiving stand 122. The illustrated electrostatic copying apparatus includes a vertical front base plate (not shown) and a vertical rear base plate 148 (FIGS. 3 and 4) arranged in spaced-apart relationship in the forward-backward direction (a direction perpendicular to the sheet surface in FIG. 2; a vertical direction in FIG. 3), and the paper receiving stand 122 is disposed between the vertical front base plate and the vertical rear base plate 148. The paper receiving stand 122 is composed of a plate-like member, and extends substantially horizontally between the vertical front base plate and the vertical rear base plate 148. The illustrated width matching means 146 includes a pair of spaced movable matching members 150 (only one of which is shown in FIG. 2). The pair of movable matching members 150 are set up so that they can move freely in the widthwise direction of the paper sheets received on the receiving stand, i.e., the aforesaid forward-backward direction in the illustrated embodiment. More specifically, the pair of movable matching members 150 can move between a receiving position at which they receive the copying paper and a matching position at which they match the positions of the paper sheets in the widthwise direction by the action of an actuating mechanism 152. The delivery roller 126 is held selectively in any one of a non-operating state (the state shown by two-dot chain lines in FIGS. 7 and 8), a first operating state (the state shown in FIGS. 1, 2, 3, 5 and 6 and by solid lines in FIGS. 7 and 8) and a second operating state (the state shown in FIGS. 9 and 10). The delivery roller 126 can be formed of a sponge, for example. Corresponding to the delivery roller 126, a frictional member 154 formed of a woven cloth is disposed on the upper surface of the receiving stand 122 with which the delivery roller 126 comes into contact (see FIGS. 6 to 8 and 10). The paper re-sending means 120 also includes copying paper movement hampering means 124. The illustrated movement hampering means 124 is composed of a pair of plate-like pieces 156 spaced from each other in the widthwise direction of the paper sheets received on the receiving stand, i.e. in the forward-backward direction (FIGS. 3 and 5). The plate-like pieces 156 are held selectively at a hampering position (the position shown in FIGS. 2 to 6 and 11 and by solid lines in FIG. 1) and a receding position (the position shown in FIGS. 9, 10 and 12 and by two-dot chain lines in FIG. 1). In the illustrated embodiment, a supporting shaft 158 is rotatably mounted across the vertical front base plate (not shown) at the forward end of the receiving stand 122 and the vertical rear base plate 148. The two opposite end portions of the supporting shaft 158 (the parts supported by the vertical front base plate and the vertical rear base plate 148) are circular in cross section, and its intermediate portion (the part extending between the vertical front base plate and the vertical rear base plate 148) are rectangular in cross section. Each plate-like piece 156 is fixed to one side surface of the intermediate portion by a screw 160 (see FIG. 4).

The paper re-sending means 120 further includes actuating mechanism 152 for moving the delivery roller 126 and the pair of plate-like pieces 156. With reference to FIGS. 2 to 5, mainly to FIG. 5, the illustrated actuating mechanism 152 has a first oscillating member 162, a second oscillating member 164 and a third oscillating member 166. The first oscillating member 162 includes a supporting side wall 168 and a side wall 170 spaced from each other in the forward-backward direction and an intermediate wall 172 connecting the supporting side wall 168 and the side wall 170, and the supporting side wall 168 and the side wall 170 are rotatably mounted on a rotating shaft 176 (on which the conveying roller 132 of a mechanism for preventing feeding of copying paper sheets in the superposed state is mounted) through a bearing member 174 (see FIGS. 3 and 5). The supporting side wall 168 of the first oscillating member 162 is positioned nearly centrally of the receiving stand in its width direction, and extends rearwardly (to the left in FIGS. 2 and 3) from the forward end side of the receiving stand 122. The aforesaid delivery roller 126 is mounted rotatably on the forward end portion of the supporting side wall 168 via a shaft member 180 (therefore, the delivery roller 126 acts on the central part in the widthwise direction of a copying paper sheet received on the receiving stand 122). The second oscillating member 164 has side walls 182 and 184 spaced from each other in the forward-backward direction and an intermediate wall 186 connecting the two side walls 182 and 184, and the side walls 182 and 184 are rotatably mounted on the rotating shaft 176. In the illustrated embodiment, the second oscillating member 164 is disposed rearwardly (upwardly in FIG. 3, and to the right in FIG. 4) of that site of the rotating shaft 176 on which the first oscillating member 162 is mounted, and a spring member 188 comprised of a coil spring, for example, is interposed between the first oscillating member 162 and the second oscillating member 164. A rearwardly extending projection 190 is provided in the upper end part of the side wall 170 of the first oscillating member 162, and a projection 192 extending in a direction away from the rotating shaft 176 is provided in the lower end part of the side wall 182 of the second oscillating member 164. The spring member 188 is engaged with the projection 190 of the first oscillating member 162 at one end and with the projection 192 of the second oscillating member at the other end. The spring member 188 acts to bias the second oscillating member 164 clockwise in FIGS. 5 and 6 relative to the first oscillating member 162. In the illustrated embodiment, a forwardly extending engaging projection 194 is further provided at the upper end part of the side wall 182 of the second oscillating member 164, and the engaging projection 194 is received in an arcuate elongate hole 196 formed in the side wall 170 of the first oscillating member 162. Accordingly, the first oscillating member 162 and the second oscillating member 164 can freely pivot relative to each other over a predetermined range. In other words, they can pivot relative to each other between a position at which the engaging projection 194 abuts against one end of the elongate hole 196 and a position at which the engaging projection 194 abuts against the other end of the elongate hole 196. The third oscillating member 166 is composed of an L-shaped member (see FIG. 3) fixed to the rear end portion of the supporting shaft 158. In relation to the third oscillating member 166, a pin member 200 (constituting an abutment portion) against which a part of the third oscillating member 166 can abut when the third oscillating member 166 pivots in the direction of an arrow 198 (FIGS. 9 and 10) is set firmly in the lower end portion of the side wall 184 of the second oscillating member 164.

Figure 6:
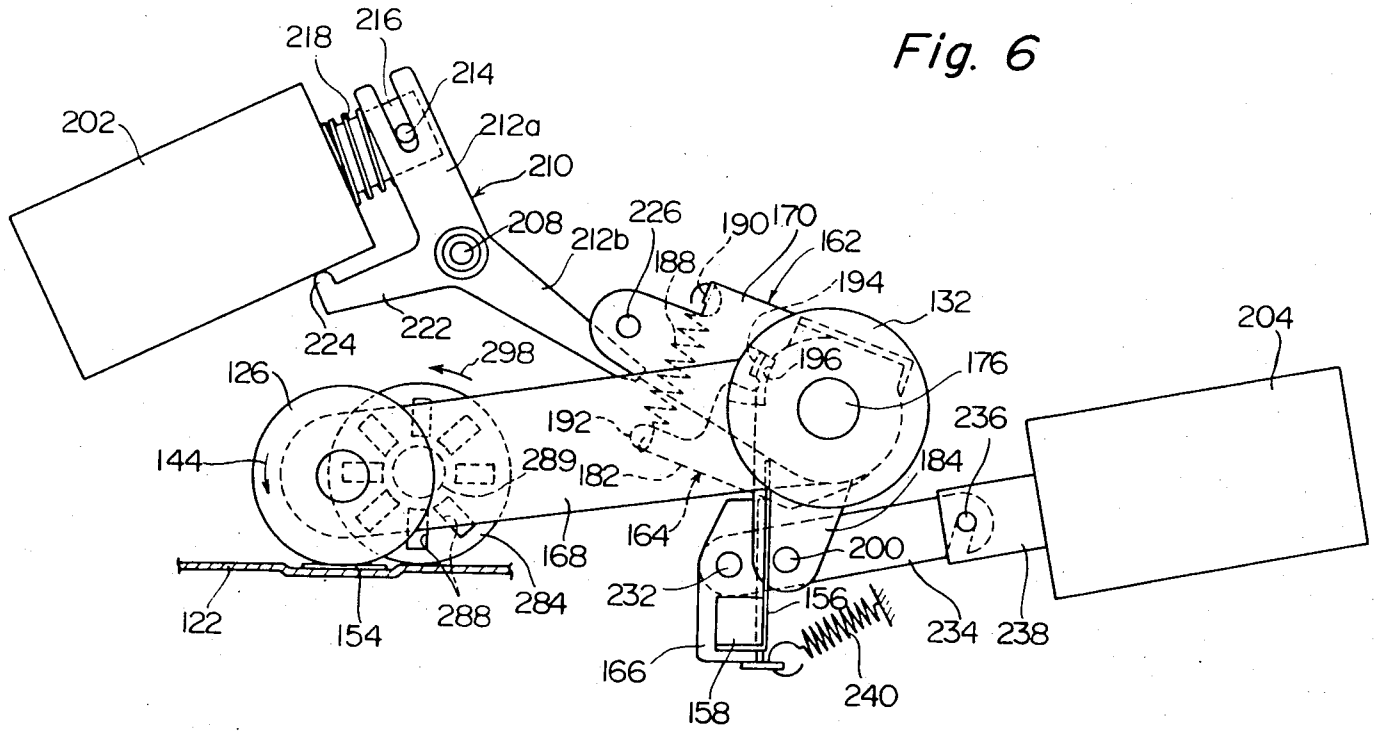
FIG. 6 is a side elevation of the front portion of the paper re-sending means of FIG. 5 when viewed from ahead of the copying apparatus.
Figure 7:
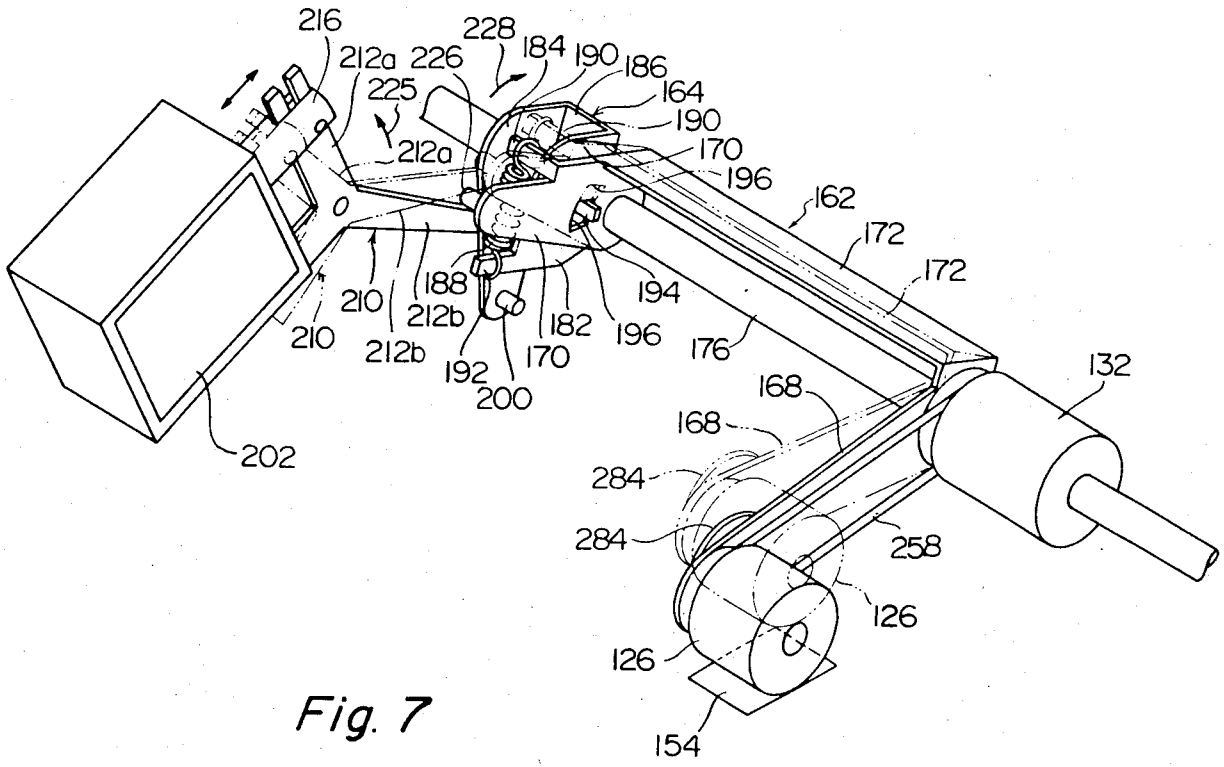
FIG. 7 is a perspective view illustrating the actuation of one of electromagnetic solenoid a copying paper re-sending means.
Figure 8:
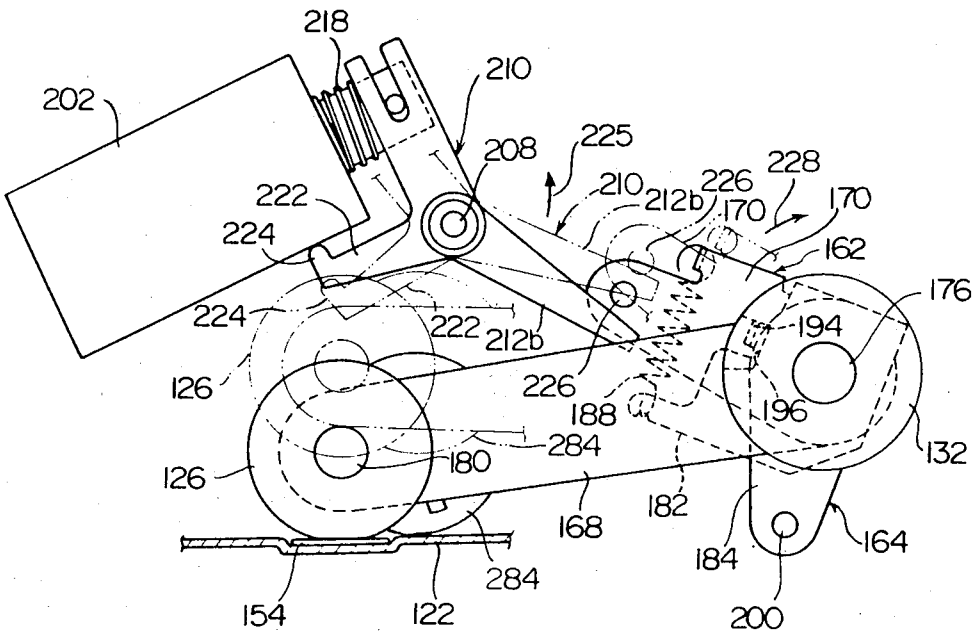
FIG. 8 is a side elevation of the state shown in FIG. 7 as viewed from ahead of the copying apparatus.
Figure 9:
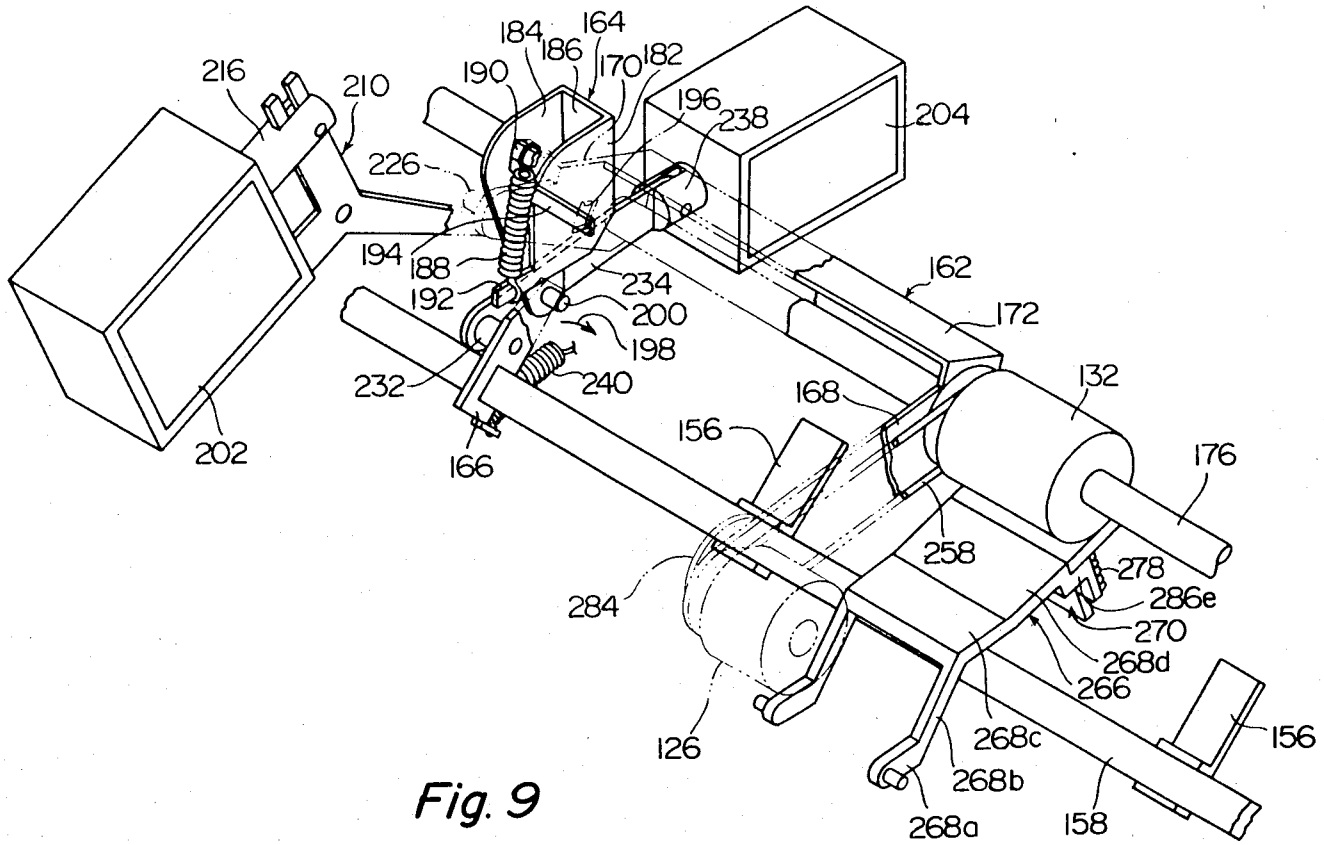
FIG. 9 is a perspective view showing the actuation of another electromagnetic solenoid of the paper re-sending means.
Figure 10:
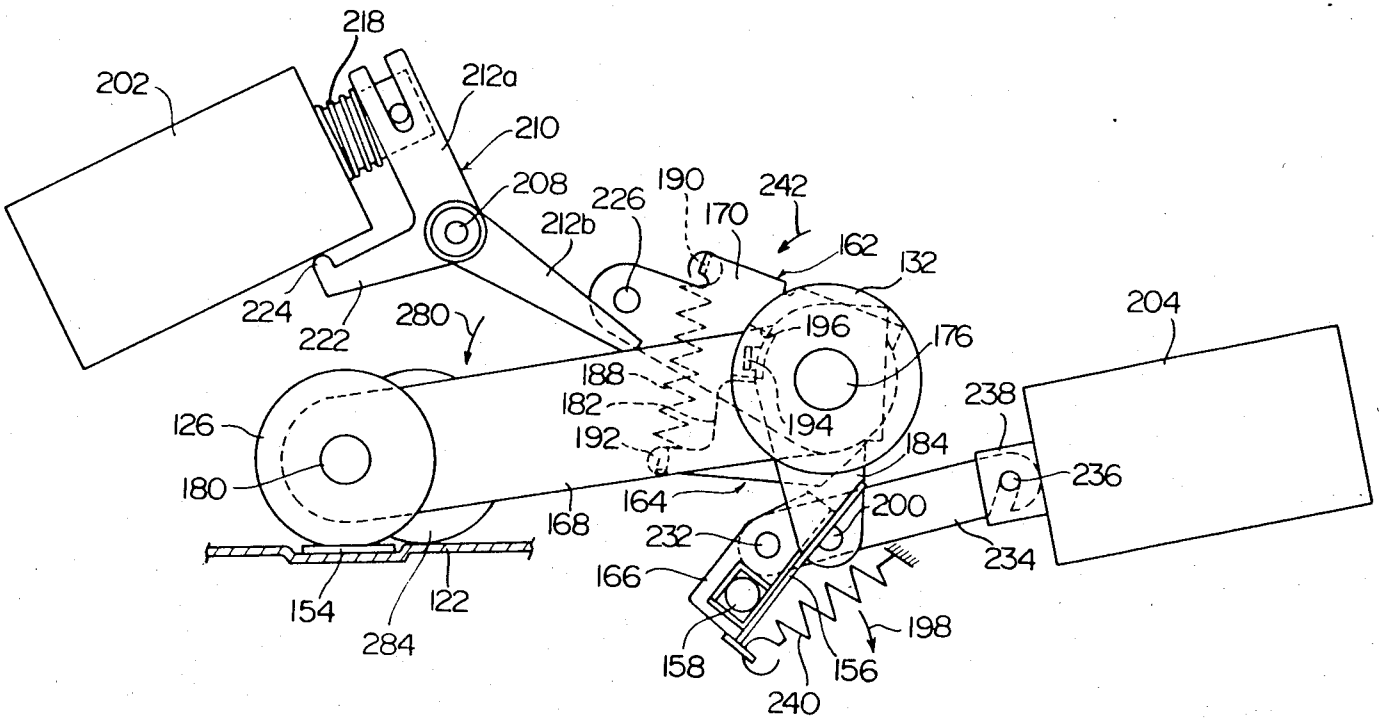
FIG. 10 is a side elevation of the state of FIG. 9 as viewed from ahead of the copying apparatus.

The illustrated actuating mechanism 152 further includes a first actuating means and a second actuating means composed of electromagnetic solenoids 202 and 204 respectively. A mounting member 206 is attached to the front surface of the vertical rear base plate 148, and the electromagnetic solenoid 202 constituting the first actuation means is mounted on the mounting member 206 (FIG. 3). A short shaft 208 is set firmly in the front surface of the vertical rear base plate 148, and a revolving lever 210 is revolvably mounted on the forward end portion of the short shaft 208. One end portion 212*a* of the revolving lever 210 is connected to an output portion 216 of the electromagnetic solenoid 202 via a linking pin 214 (FIGS. 6, 8 and 10). A coil spring 218 (not shown in FIGS. 2, 3, 5, 7 and 9) is interposed between the electromagnetic solenoid 202 and the revolving lever 210 and covers the output portion 216. A projecting portion 222 having an abutting part 224 is provided in the revolving lever 210 (see FIGS. 6, 8 and 10). Hence, when the electromagnetic solenoid 202 is inoperative, the revolving lever 210 is held by the action of the coil spring 218 at an angular position at which the abutting part 224 of the projecting portion 222 abuts against the electromagnetic solenoid 202 (the position shown in FIGS. 2 to 6, 9 and 10, and the position shown by solid lines in FIGS. 7 and 8). A pin member 226 (constituting an abutment portion) against which the other end portion 212*b* of the revolving lever 210 can abut when the revolving lever 210 is pivoted in the direction shown by an arrow 225 (FIGS. 7 and 8) is set firmly in the forward end part of the side wall 170 of the first oscillating member 162. Accordingly, when the electromagnetic solenoid 202 is actuated, the revolving lever 210 is revolved in the direction shown by the arrow 225 (FIGS. 7 and 8) against the elastic biasing action of the coil spring 218, and the other end portion 212*b* of the revolving lever 210 abuts against, and thereby acts on, the pin member 226 provided in the first oscillating member 162. As a result, the first oscillating member 162 is pivoted about the rotating shaft 176 in a direction shown by an arrow 228 (FIGS. 7 and 8), namely clockwise in FIGS. 7 and 8. The electromagnetic solenoid 204 constituting the second actuating means is mounted on a plate-like mounting member 230 secured to the front surface of the vertical rear base plate 148 (FIG. 3). One end portion of a linking member 234 is connected to the third oscillating member 166 through a pin member 232, and the other end portion of the linking member 234 is connected to an output portion 238 of the electromagnetic solenoid 204. A spring member 240 composed of, for example, a coil spring is interposed between the third oscillating member 166 and a part of the electrostatic copying apparatus. Accordingly, when the electromagnetic solenoid 204 is inoperative, the third oscillating member 166 is held at the position shown in FIGS. 2 to 6 and 11 by the action of the spring member 240. As will be understood from FIG. 2, at this position, the pair of plate-like pieces 156 abut against the front end of the receiving stand 122 and thus the third oscillating member 166 is held at the aforesaid position. Furthermore, as can be understood from FIGS. 2, 4 and 5, the plate-like pieces 156 are held at an operating position at which they project upwardly from the upper surface of the receiving stand 122. On the other hand, when the electromagnetic solenoid 204 is actuated, the third oscillating member 166 is privoted in the direction shown by the arrow 198 (FIGS. 9 and 10) together with the supporting shaft 158 via the linking member 234 against the elastic biasing action of the spring member 240. As a result, a part of the third oscillating member 166 abuts against, and acts on, the pin member 200 provided in the second oscillating member 164, and the second oscillating member 164 is pivoted in the direction shown by an arrow 242 (FIG. 10) about the rotating shaft 176 as a center. When the third oscillating member 166 is pivoted in the direction of the arrow 198, the supporting shaft 158 and the pair of plate-like pieces 156 mounted on it are likewise pivoted as a unit, and the plate-like pieces 156 are held at the receding position (the position shown in FIGS. 9, 10 and 12) at which they have receded, and thus are apart, from the upper surface of the receiving stand 122.

Figure 11:
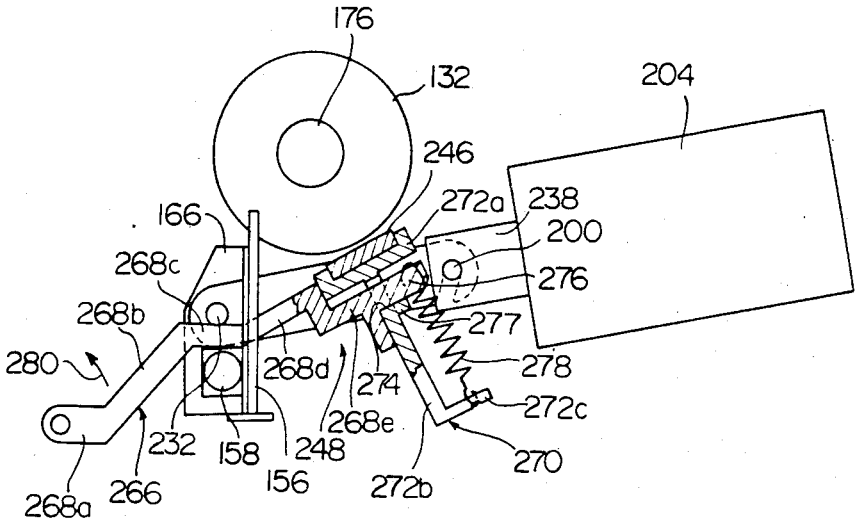
FIG. 11 is a side elevation, partly in section, showing the state of means for preventing feeding of copying paper sheets in the superposed state when the aforesaid another electromagnetic solenoid of the paper re-sending means is inoperative.
Figure 12:
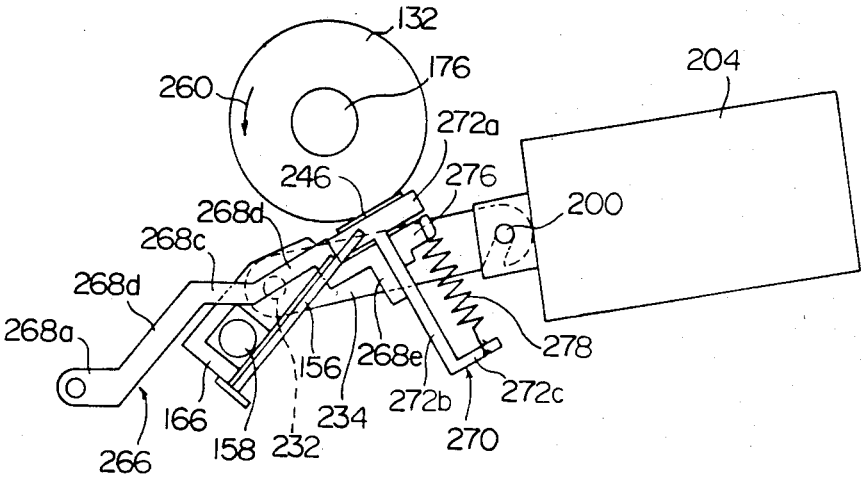
FIG. 12 is a side elevation showing the state of the means for preventing feeding of copying paper sheets in the superposed state when the aforesaid electromagnetic solenoid of the copying paper re-sending means is in operation.

In the illustrated electrostatic copying apparatus, a mechanism 178 for preventing feeding of copying paper sheets in the superposed state is provided in relation to the paper re-sending means 120 downstream of the re-sending means 120 as viewed in the paper conveying direction shown by an arrow 244 (FIGS. 2 and 3). With reference to FIGS. 2, 5 and 11, the preventing mechanism 178 includes conveying roller 132 constituting a part of the paper re-feeding means, a frictional member 246 disposed at a position confronting the conveying roller 132, and a pressing mechanism 248 for moving the frictional member 246. The rotating shaft 176 is rotatably mounted through a bearing member 250 between the vertical front base plate (not shown) and the vertical rear base plate 148 (FIGS. 3 and 4, in FIGS. 3 and 4, the rear end portion of the rotating shaft 176 is shown), and the conveyor roller 132 is mounted on the middle portion of the rotating shaft 176. Accordingly, the conveying roller 132 acts on the central part in the widthwise direction of the copying paper delivered from the receiving stand 122. The rear end portion of the rotating shaft 176 projects rearwardly through the vertical rear base plate 148, and a power transmission member 252 such as a gear is fixed to the rear end portion of the rotating shaft 176 (see FIG. 4). The power transmission member 252 is drivingly connected to a main driving source of the electrostatic copying apparatus through a suitable power transmission means (not shown) such as a gear. A pulley portion 254 is provided at one end portion of the conveying roller 132, and a pulley portion 256 is provided at one end portion of the delivery roller 126. A power transmission member 258 such as a wire is wrapped about the two pulley portions 254 and 256. Hence, when the main driving source (not shown) is actuated, the conveying roller 132 is rotated in the direction shown by an arrow 260 (FIGS. 2 and 5) via the rotating shaft 176, and the delivery roller 126 is rotated in the direction shown by the arrow 144 (FIGS. 1, 2 and 5) via the power transmission member 258.

The pressing mechanism 248 in the illustrated embodiment includes an oscillating arm 266 pivotably mounted on a projecting piece 264 (FIG. 2) provided in the under surface of the receiving stand 122. With reference mainly to FIG. 11, the illustrated oscillating arm 266 has a base portion 268*a* mounted pivotably on the projecting piece 264, an inclined portion 268*b* extending at an incline from the base portion 268*a*, an abutting middle portion 268*c* extending nearly horizontally from the inclined portion 268*b*, an inclined portion extending at an incline from the abutting middle portion 268*c*, and a mounting portion 268*e* present at one end of the inclined portion 268*d*, i.e. the forward end of the oscillating arm 266. A supporting member 270 movable toward and away from the conveying roller 132 is mounted on the mounting portion 268*e*, and the frictional member 246 is mounted on the supporting member 270. In the illustrated embodiment, the supporting member 270 has a supporting portion 272*a*, a downwardly extending portion 272*b* extending from the supporting portion 272*a*, and an engaging portion 272*c* provided at the lower end of the downwardly extending portion 272*b*, and the frictional member 246 is fixed within a depressed portion formed on the upper surface of the supporting portion 272*a*. An elongate hole 274 is formed in the downwardly extending portion 272*b* of the supporting member 270. On the other hand, a projecting portion 276 is provided at the forward end of the oscillating arm 266, or more specifically at the forward end of its mounting portion 268*e*, and is received in the elongate hole 274 of the supporting member 270. Hence, the supporting member 270 can move relative to the oscillating arm 266 between a position at which one end of the elongate hole 274 abuts against the projecting portion 276 and a position at which the other end of the elongate hole 274 abuts against the projecting portion 276. Incidentally, an engaging member 277 is mounted on the forward end portion of the projecting portion 276 to prevent detachment of the supporting member 270. A pressing spring member 278 composed of, for example, a coil spring is mounted between the forward end of the projecting portion 276 of the oscillating arm 266 and the engaging portion 272*c* of the supporting member 270. The pressing spring member 278 functions to bias the supporting member 270 relative to the oscillating arm 266 in a direction in which the supporting member 270 approaches the conveying roller 132, and therefore, the supporting member 270 is normally maintained in the state shown in FIG. 11, namely in a state in which the lower end of the elongate hole 274 abuts against the projecting portion 276.

In the illustrated embodiment, the oscillating arm 266 is adapted to pivot by the action of the electromagnetic solenoid 204 for pivoting the pair of plate-like pieces 156. With reference to FIGS. 5 and 11, the oscillating arm 266 of the pressing mechanism 248 is disposed above the middle portion of the supporting shaft 158 having the plate-like piece 156 mounted thereon. The oscillating arm 266 tends to pivot clockwise in FIG. 11 owing to its own weight, and therefore, when the plate-like pieces 156 are held at the aforesaid hampering position (when the electromagnetic solenoid 204 is inoperative), the under surface of the abutting middle portion 268*c* of the oscillating arm 266 abuts against one side surface of the middle portion of the supporting shaft 158 (as stated above, the middle portion is rectangular in cross section) and the oscillating arm 266 is held at a position shown in FIG. 11. The frictional member 246 is maintained in the inoperative state in which it is apart from the conveying roller (see FIG. 11). On the other hand, when the electromagnetic solenoid 204 is actuated to hold the pair of plate-like pieces 156 in the aforesaid receding position, one corner part of the supporting shaft 158 acts on the under surface of the abutting middle portion 268*c* by the revolving of the supporting shaft 158. As a result, the oscillating arm 266 is slightly pivoted counterclockwise as shown by an arrow 280 (FIG. 11) the oscillating arm 266 is held at the position shown in FIG. 12, and the frictional member 246 is maintained in the operating state in which it is in pressing contact with the peripheral surface of the conveying roller 132 (see FIG. 12). The conveying roller 132 can be formed of, for example, a synthetic rubber, and the frictional member 246 can be formed of, for example, a urethane rubber.

In the illustrated embodiment, the oscillating arm 266 is pivoted by using the electromagnetic solenoid 204 adapted to move the plate-like pieces 156. If desired, an actuating means such as an electromagnetic solenoid may be used exclusively for pivoting the oscillating arm.

In the illustrated electrostatic copying apparatus, a copying paper detecting mechanism constructed in accordance with this invention is also provided in relation to the paper re-sending means 120. With reference to FIGS. 3, 5 and 6, the illustrated paper detecting mechanism 282 includes a follower roller 284 and a detecting means 286 for detecting the rotation of the follower roller 284. The follower roller 284 is constructed of a disc-like member, and a plurality of circumferentially spaced rectangular openings 288 are formed on its side surface (FIG. 6). The follower roller 284 is rotatably mounted on the forward end portion of a supporting side wall 168 of the first oscillating member 162 (which also acts as a supporting member for supporting the follower roller 284) via a short shaft 289. In the illustrated embodiment, the follower roller 284 is mounted on that surface of the supporting side wall 168 which is opposite to the surface on which the delivery roller 126 is mounted, as shown in FIG. 3. Accordingly, the follower roller 284 is moved up and down together with the delivery roller 126 as the first oscillating member 162 makes a pivotal movement. It is importat to construct the follower roller 284 such that when the peripheral surface of the delivery roller 126 acts on a copying paper sheet on the receiving stand 122, the peripheral surface of the follower roller 284 also acts in the same way. In the illustrated embodiment, the follower roller 284 is rotatably mounted on the first oscillating member 162 on which the delivery roller 126 is mounted. Instead of this construction, it is possible to provide a supporting member adapted to move up and down independently from the first oscillating member 162, and rotatably mount the follower roller 284 on this supporting member.

The illustrated detecting means 286 is composed of a combination of a light emitting element 290 and a light receiving element 292. The light emitting element 290 is provided on one side (on the upper side in FIG. 3) of the follower roller 284, and the light receiving element 292 is disposed on the other side (the lower side in FIG. 3) of the follower roller 284. The light emitting element 290 and light receiving element 292 are mounted on a mounting block 294 in spaced-apart relationship in the forward-backward direction, and the mounting block 294 is fixed to the lower end of a downwardly extending member 296 provided within the electrostatic copying apparatus. The detecting means 286 may be mounted on the first oscillating member 162 instead of mounting it on the main body of the copying apparatus. In this case, the positional relationship between the follower roller 284 and the detecting means 286 can be maintained constant irrespective of the number of copying paper sheets received in the stacked state on the receiving stand 122.

Now, with reference mainly to FIGS. 2, 5 and 6, the operation and advantage of the paper re-sending means 120 explained above will be described.

In copying a document on both surfaces of a copying paper sheet, the electromagnetic solenoid 202 and 204 are maintained inoperative. Hence, the third oscillating member 166 is biased counterclockwise as shown in FIGS. 5 and 6 by the action of the spring member 240, and by the abutting of the air of plate-like pieces 156 against the forward end of the paper receiving stand 122, is held at the angular position shown in FIGS. 2 to 6. In this state, the forward end portion of each of the plate-like pieces 156 projects upwardly from the upper surface of the receiving stand 122, and each plate-like piece 156 is exactly held at the hampering position (the position shown in FIG. 1 by solid lines and also in FIGS. 2 to 6 and 12) by the action of the spring member 240. Furthermore, in the aforesaid state, the abutting middle portion 268*c* of the oscillating arm 266 abuts against one side surface of the middle portion of the supporting shaft 158, and the oscillating arm 266 is held at a second position (the position shown in FIG. 11) spaced from the conveying roller 132. When the oscillating arm 266 is at the second position, the frictional member 246 is held in the non-operating state (the state shown in FIG. 11) in which it is apart from the peripheral surface of the conveying roller 132 and does not act on the peripheral surface of the conveying roller 132. Furthermore, the revolving lever 210 is biased clockwise as shown in FIGS. 5 and 6 by the action of the coil spring 218 and the abutting portion 224 provided in its projecting portion 222 abuts against a part of the main body of the electromagnetic solenoid 202, whereby the revolving lever 210 is held at the angular position shown in FIGS. 2 to 6 and by solid lines in FIGS. 7 and 8. It will be appreciated from the foregoing description taken in conjunction with FIGS. 5 and 6 that when the electromagnetic solenoids 202 and 204 are in the inoperative state, the first oscillating member 162 and the second oscillating member 164 are free to pivot over a predetermined range with respect to the rotating shaft 176, and therefore, the delivery roller 126 abuts against the upper surface of the receiving stand 122 by its own weight and is held at the first operating state (the state shown in FIGS. 2 to 6) in which it presses the upper surface of the receiving stand 122 relatively weakly (at this time, the follower roller 284 also abuts against the upper surface of the receiving stand as shown in FIG. 6). At this time, the first oscillating member 162 is held at the angular position shown in FIGS. 2 to 6 as a result of the delivery roller 126 abutting against the upper surface of the receiving stand 122 (therefore, as shown in FIGS. 5 and 6, some space exists between the other end portion 212*b* of the revolving lever 210 and the pin member 226 provided in the side wall 170 of the first oscillating member 162). The second oscillating member 164 is biased clockwise in FIGS. 5 and 6 by the action of the spring member 188 interposed between the projection 192 of the side wall 182 and the projection 190 provided in the side wall 170 of the first oscillating member 162, and held at the angular position shown in FIGS. 2 to 6 and also by solid lines in FIGS. 7 and 8 at which its engaging projection 194 abuts against one end of the elongate hole 196 formed in the side wall 170 (the upper end of the elongate hole 196 in FIGS. 5 and 6). Hence, as shown in FIGS. 5 and 6, some space exists between the pin member 200 provided in the side wall 184 of the second oscillating member 164 and the third oscillating member 166.

When a copying paper sheet having an image formed on one surface has been returned to the paper receiving stand 122 as described above, it is received on the receiving stand 122 and moved along the upper surface of the stand 122 in the direction of the arrow 244 (FIGS. 2 and 3). When the copying paper is conveyed to the delivery roller 126, the delivery roller 126 acts relatively weakly on the upper surface of the copying paper, and the copying paper is further moved downsteam by the action of the delivery roller 126 rotating in the direction of the arrow 144 (FIGS. 1, 2, 5 and 6). When the copying paper is thus moved and its leading end arrives at the follower roller 284, the leading end portion of the copying paper being moved downstream by the action of the delivery roller 126 acts on the follower roller 284. The follower roller 284 thus undergoes the action of the copying paper and moves in the direction shown by an arrow 298 (FIG. 6). As a result, the plurality of openings 188 formed in the follower roller 284 move in the desired required manner. When an opening 288 passes between the light emitting element 290 and the light receiving element 292, the light from the light emitting element 290 is projected onto the light receiving element 292 through the opening 288. Consequently, the detecting means 286 detects the arrival of the copying paper at the receiving stand 122. When the copying paper is further moved downstream, its leading edge abuts against the pair of plate-like pieces 156 held at the hampering position whereby the movement of the copying paper is hampered exactly. At this time, the delivery roller 126 is maintained in the first operating state and acts relatively weakly on the upper surface of the copying paper. Accordingly, when the movement of the copying paper is hampered, slippage occurs between the upper surface of the copying paper and the peripheral surface of the delivery roller 126 and the copying paper is exactly stopped without being bent or deflected by the action of the delivery roller 126. When the movement of the copying paper stops, the movement of the follower roller 284 also stops. The rolling of the follower roller 284 is continued from the arrival of the leading edge of the copying paper at the follower roller 284 until it touches the pair of the plate-like pieces 156. For easy detection of the arrival of the copying paper, therefore, it is desirable to set the distances between the openings 288 such that one of the openings 288 passes between the light emitting element 290 and the light receiving element 292 during the aforesaid rolling of the following roller 284. If desired, however, the above distances may be set so that two or more openings 288 pass between the light emitting element 290 and the light receiving element 292 during the aforesaid rolling period.

When the copying paper is thus received on the receiving stand 122, the electromagnetic solenoid 202 is then actuated, and then the pair of movable matching members 150 are moved in the desired manner. The actuation of the electromagnetic solenoid 202 causes the revolving lever 210 to revolve in the direction of the arrow 225 (FIGS. 7 and 8), and the other end portion 212*b* of the revolving lever 210 acts on the pin member 226 provided in the first oscillating member 162 to pivot the first oscillating member 162 in the direction of the arrow 228 (FIGS. 7 and 8) about the rotating shaft 176 as a center. As a result, the delivery roller 126 moves away from the copying paper on the receiving stand 122 and is positioned above the copying paper and thus maintained in the inoperative state shown by two-dot chain lines in FIGS. 7 and 8 (at this time, the following roller 284 is also positioned above the copying paper together with the delivery roller 126). It will be easily understood from FIG. 6 that upon the pivoting of the first oscillating member 162 in the direction of the arrow 225, the first oscillating member 162 and the second oscillating member 164 are pivoted together in the direction of the arrow 225 during the early stage of the pivoting movement, but when the second oscillating member 164 has been pivoted by a predetermined angle, the pin member 200 provided in its side wall 184 abuts against the third oscillating member 166; and therefore that after the pin member 200 has abutted against the third oscillating member 166, the pivoting movement of the second oscillating member 164 is restrained and only the first oscillating member 162 is pivoted in the direction of the arrow 225 against the biasing action of the spring member 188 (therefore, when the delivery rooler 126 is in the inoperative state owing to this, the engaging projection 194 of the second oscillating member 164 is located in the middle portion of the elongate hole 196 formed in the first oscillatling member 162). Thus, when the electromagnetic solenoid 202 is actuated, the state shown in FIGS. 7 and 8 is created. It will be easily understood from the foregoing description that in this state, the pair of plate-like pieces 156 are held at the hampering position, the frictional member 246 is mainiained in the aforesaid inoperative state, and the delivery roller 126 is maintained in the aforesaid inoperative state. When the pair of movable matching members 150 are then moved in the desired manner in the forward-backward direction, namely in the widthwise direction of the copying paper received in the receiving stand 122, the inner surfaces of the movable matching members 150 act respectively on the two side edges of the copying paper in the receiving stand 122 to position the copying paper at a predetermined site on the receiving stand 122. Since the delivery roller 126 is held at the aforesaid inoperative position and does not act on the copying paper on the receiving stand, the positioning of the copying paper in the widthwise direction is exactly carried out as desired.

When the copying paper has been positioned as stated above, the electromagnetic solenoid 202 is deenergized. As a result, the first oscillating member 162 is pivoted in a direction opposite to the direction of the arrow 228 (FIGS. 7 and 8) by the weight of the delivery roller 126, etc., and the delivery roller 126, due to its weight, abuts against the upper surface of the copying paper received on the receiving stand 122 and presses it relatively weakly (therefore it is again maintained in the first operating state). In relation to this, the revolving lever 210 and the second oscillating member 164 return to their original angular positions shown in FIGS. 2 to 6 and by solid lines in FIGS. 7 and 8. Hence, the follower roller 284 also abuts against the copying paper on the receiving stand 122.

In the case of forming a copied image on both surfaces of one copying paper sheet, the copying paper sheet having an image formed on one surface is temporarily stored on the receiving stand 122.

In the case of producing a plurality of copies on both surfaces, one copying paper is received on the receiving stand 122 as stated above, and then, the next copying paper is received on the first copying paper and moved on the upper surface of the first copying paper. When the next copying paper is conveyed to the follower roller 284 in the same way as above, the first copying paper acts on the follower roller 284, which again undergoes the action of the next copying paper moved and rolls in the direction shown by the arrow 298. As a result, by the rolling of the follower roller 284, the light from the light emitting element 290 is projected into the light receiving element 294 through the opening 288 formed in the follower roller 284, and the detecting means 286 detects the arrival of the next copying paper at the receiving stand 122. Accordingly, even when two or more copying paper sheets are received in the stacked state on the receiving stand 122, another copying paper sheet subsequently conveyed to the stack of copying paper sheets acts on the follower roller 284 to set it in motion, and therefore, the paper detecting means 282 can exactly detect the copying paper subsequently conveyed to the receiving stand 122. When the next copying paper has been moved downstream to the pair of plate-like pieces 156 as stated above, it abuts against the plate-like pieces 156 held at the hampering position and its further movement stops. Thereafter, the electromagnetic solenoid 202 is actuated to move the pair of movable matching members 150 as desired. As a result, the matching members 150 match the position of the next copying paper in the widthwise direction and it is put into proper coordination with the copying paper on the receiving stand. When this widthwise matching or the widthwise positioning is over, the electromagnetic solenoid 202 is again deenergized, and the delivery roller 126 is again maintained in the first operating state. In the production of a plurarity of copies on both surfaces, the above operation is repeated, and the copying papers having a copied image on one surface are received in the stacked state on the receiving stand 122 and matched, and temporarily stored before an image is formed on the other surface. It will be understood from the foregoing description that when the delivery roller 126 is in the first operating state, the first oscillating member 162 is pivoted slightly in the direction of the arrow 228 (FIGS. 7 and 8), and the delivery roller 126 and the follower roller 284 are slightly elevated, as the number of the copying paper sheets stacked on the receiving stand 122 increases.

To re-feed the copying paper on the receiving stand 122 toward the paper conveying passage 58 through the paper re-feeding passage 128, the electromagnetic solenoid 204 is actuated. As a result, the third oscillating member 166 is pivoted through the linking member 234 in the direction of the arrow 198 (FIGS. 9 and 10) against the force of the spring member 240, and the supporting shaft 158 and the pair of plate-like pieces 156 are pivoted as a unit with the third oscillating member 166 whereby the plate-like pieces 156 are held at the receding positions (FIGS. 9 and 10) at which they have receded from the upper surface of the receiving stand 122. At the receding positions, the plate-like pieces 156 do not act on the copying paper sheets received on the receiving stand, and the copying paper is ready for feeding as will be described below. Furthermore, when the supporting shaft 158 is rotated as described above, its corner portion acts on the abutting middle portion **268*c* of the oscillating arm 266 to pivot the oscillating arm 266 slightly in the direction shown by the arrow 280 (FIG. 11) and maintain the frictional member 246 in the operating state in which it is kept in pressing contact with the peripheral surface of the conveying roller 132 (the state shown in FIG. 12). It will be readily appreciated by comparing FIG. 11 with FIG. 12 that in this operating state, owing to the press-contacting of the frictional member 246 with the peripheral surface of the conveying roller 132, the supporting member 270 is moved in a direction away from the conveying roller 132 relative to the mounting portion 268***e* of the oscillating arm 266 against the biasing force of the pressing spring member 278, and the frictional member 246 is elastically kept in pressing contact with the peripheral surface of the conveying roller 132 by the elastic recovering force of the pressing spring member 278 (therefore, at this time, the projecting portion 276 provided in the oscillating arm 266 is positioned in the middle portion of the elongate hole 274 formed in the supporting member 270). When the third oscillating member 166 is pivoted in the direction shown by the arrow 198, a pair of it acts on the pin member 200 provided in the second oscillating member 164 to pivot the second oscillating member 164 in the direction of the arrow 242 (FIG. 10) about the rotating shaft 176 as a center. Since at this time, the delivery roller 126 acts on the upper surface of the copying paper on the receiving stand 122, the second oscillating member 164 is pivoted relative to the first oscillating member 162 and the spring member 188 interposed between them is expanded. Consequently, the spring member 188 biases the first oscillating member 162 in the direction shown by the arrow 280 (FIG. 10), namely counterclockwise in FIG. 10, and the delivery roller 126 is pressed elastically against the copying paper on the receiving stand by the action of the spring member 188 and maintained in the second operating state in which it presses the copying paper relatively strongly (the state shown in FIGS. 9 and 10). At this time, the engaging projection 194 provided on the second oscillating member 164 is positioned in the middle portion of the elongate hole 196 formed in the first oscillating member 162. Thus, by the action of the delivery roller 126 being rotated in the direction of the arrow 144 (FIG. 2), the copying paper on the receiving stand 122 is delivered in the direction of the arrow 244 (FIGS. 2 and 3) toward the preventing mechanism 178 for preventing feeding of copying papers in the superposed state which is present on the downstream side). Since the delivery roller 126 acts relatively strongly on the copying paper on the receiving stand 122 at the time of delivery, the paper is exactly delivered.

When two or more copying paper sheets are received in the stacked state on the receiving stand 122, the delivery roller 126 acts relatively strongly on the upper surface of the uppermost copying paper of the stack and delivers the uppermost copying paper toward the preventing mechanism 178. When the number of the copying paper sheets on the receiving stand 122 decreases as a result of delivery, the first oscillating member 162 is pivoted in the direction of the arrow 280 (FIG. 10) by the action of the spring member 188 in the aforesaid second operating state. Hence, the delivery roller 126 always presses the upper surface of the uppermost copying paper with a relatively strong pressure, and thereby exactly delivers it as desired, irrespective of the number of the copying paper sheets on the receiving stand 122.

When the copying paper delivered from the receiving stand 122 is conveyed to the preventing mechanism 178, the conveying roller 132 rotating in the direction of the arrow 260 (FIGS. 2 and 5) acts on the upper surface of the copying paper, and the copying paper is again fed toward the paper conveying passage 58 by the action of the conveying roller 132. When, for example, two copying paper sheets are delivered in the superposed state from the receiving stand, the conveying roller 132 acts on the upper surface of the upper copying paper and the frictional member 246 acts on the undersurface of the lower copying paper whereby the movement of the lower paper alone is hampered by the frictional member 246. At this time, the papers undergo the separating action of the preventing mechanism 178, and only the upper copying paper is conveyed by the action of the conveying roller 132.

The illustrated electrostatic copying paper is constructed such that when paper apparatus jamming occurs in the various passages through which the copying paper is conveyed (for example, the paper conveying passage 58, the paper returning passage 110 and the paper re-feeding passage 128), the power supply of the apparatus can be cut off at the time of removing the paper that has jammed (for example, the power supply can be cut off by opening the front cover, not shown, of the electrostatic copying apparatus). When the operator is removing the paper that has jammed near the preventing mechanism 178, for example, the power supply is off to make the electromagnetic solenoids 202 and 204 inoperative. When the electromagnetic solenoids 202 and 204 become inoperative, the paper re-sending means 120 assumes the state shown in FIGS. 2 to 6 and 11, and the frictional member 246 is rendered inoperative as stated above. As a result, the frictional member 246 moves away from the peripheral surface of the conveying roller 132, and as can be easily understood from FIG. 11, the paper that has jammed near the preventing mechanism 178 can be removed easily.

It is to be understood that the accompanying drawings show the absence of copying paper on the receiving stand 122.

Since in the illustrated embodiment described above, the delivery roller 126 is maintained in the first operating state in which it acts on the paper relatively weakly when conducting the paper to the receiving stand 122, and in the second operating state in which it relatively strongly acts on the paper when delivering the paper from the receiving stand 122, this single roller can serve both as a conveyance assisting roller and a delivery roller conventionally provided above the paper receiving stand, and the structure of the paper re-sending means 120 can be relatively simplified.

Furthermore, in the illustrated embodiment, actuations of the delivery roller 126 and the plate-like pieces 156 are controlled by two electromagnetic solenoids 202 and 204. Hence, the structure of the actuating mechanism 152 can be relatively simplified.

Further, since in the illustrated embodiment, the frictional member 246 is maintained selectively in the inoperative state in which it is apart from the conveying roller 132 and in the operating state in which it is kept in pressing contact with the peripheral surface of the conveying roller, the wear of the frictional member 246 can be effectively inhibited so that its function to prevent feeding of paper sheets in the superposed state can be retained over an extended period of time.

Moreover, in the illustrated embodiment, the frictional member 246 is maintained in the inoperative state and the operating state in relation to the movement of the plate-like pieces 156. It is not necessary therefore to provide a separate actuating source, and the desired effect can be achieved by a relatively simple structure.

In the illustrated embodiment, the movement hampering means 124 is adapted to be held at the receding position by the action of the electromagnetic solenoid 204 for maintaining the delivery roller 126 in the second operating state. Alternatively, it is possible to provide an actuating means for exclusive use in moving the movement hampering means 124 in the required manner and hold the movement hampering means selectively at the hampering position and the receding position by this actuating means.

In the illustrated embodiment, the movement hampering means 124 projects upwardly from the upper surface of the receiving stand 122 when it is at the hampering position, and recedes from the upper surface of the receiving stand 122 when it is at the receding position. In place of this construction, it is possible to construct the movement hampering means 124 so as to be movable in the widthwise direction of the copying paper to be received on the receiving stand 122 and adapt it to act on the copying paper on the receiving stand 122 when it is at the hampering position, and move in the widthwise direction of the copying paper away from the copying paper when it is at the receding position.

While in the above embodiment the paper detecting mechanism 282 is applied to the paper re-sending means 120, it is not limited to this combination, and can be used as a detecting mechanism for detecting a sheet material in electrostatic copying apparatuses of various types.

Modified embodiment of the paper re-sending means

Figure 13:
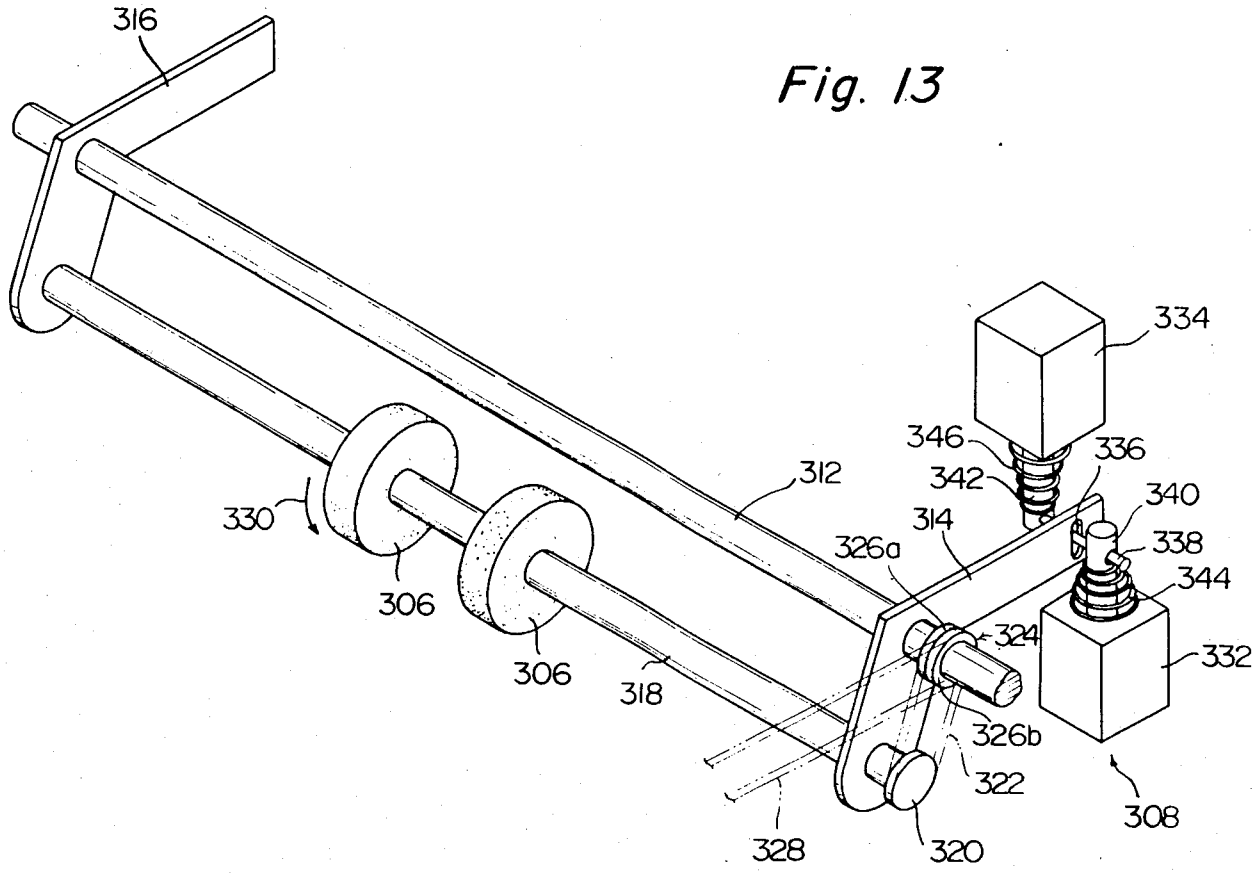
FIG. 13 is a perspective view showing an actuating mechanism in a modified example of the paper re-sending means.
Figure 14:
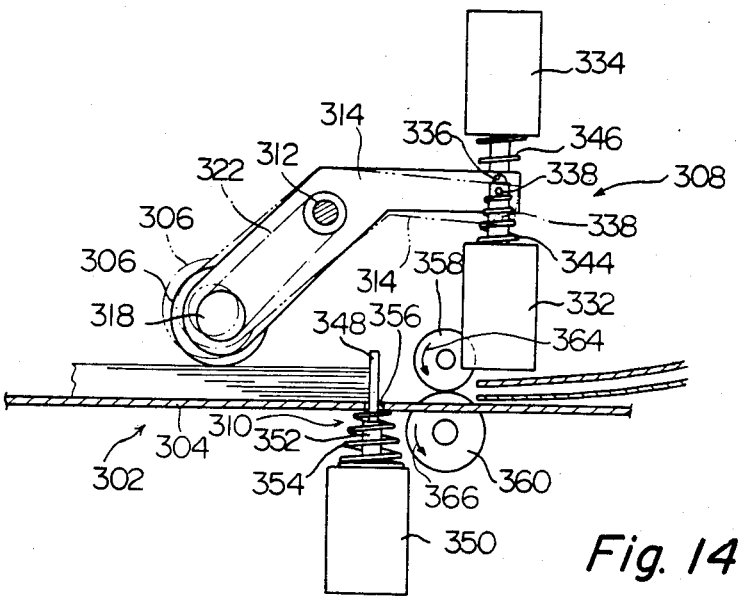
FIGS. 14 and 15 are side elevation views illustrating the states wherein the one electromagnetic solenoid and the another electromagnetic solenoid in the actuating mechanism in FIG. 13 are in operation.
Figure 15:
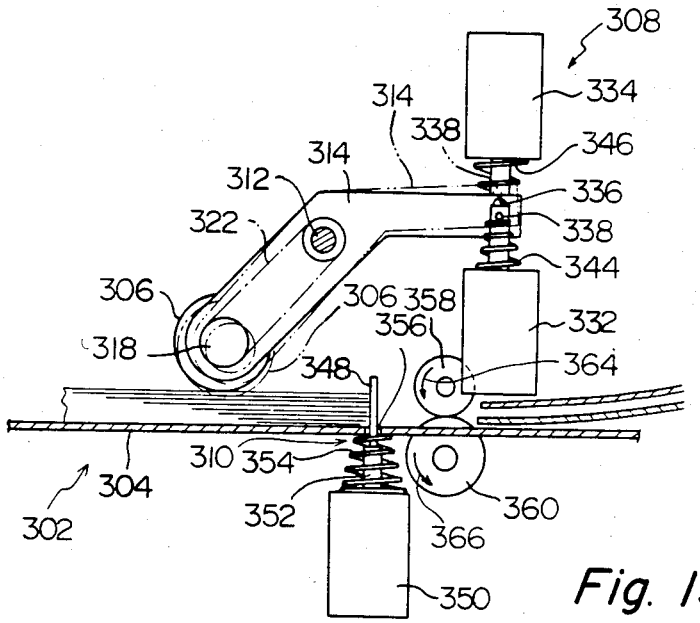

With reference to FIGS. 13 to 15, a modified embodiment of the paper re-sending means will be described. The illustrated paper re-sending means 302 includes a copying paper receiving stand 304, a delivery roller 306 disposed above the paper receiving stand 304 (constituting delivery means), an actuating mechanism 308 for moving the delivery roller 306 in the desired manner, a width matching means (not shown) for matching the widthwise position of a copying paper sheet, a copying paper movement hampering means 310 for hampering the movement of copying paper. In this modified embodiment, the structures of the actuating mechanism 308 and the movement hampering means 310 differ from those shown in FIGS. 1 to 12, but the structures of the other members are substantially the same as in the embodiment described hereinabove.

With reference to FIGS. 13 and 14, a rotating shaft 312 is rotatably mounted between the vertical front base plate and the vertical rear base plate (not shown) of the electrostatic copying apparatus. The actuating mechanism 308 in the modified embodiment includes a pair of oscillating supporting members 314 and 316 which are mounted for oscillation on the opposite end portions of the rotating shaft 312. A supporting shaft 318 is rotatably mounted between end portions of the nearly L-shaped oscillating supporting members 314 and 316, and a pair of delivery rollers 306 constituting the delivery means are mounted on the supporting shaft 318. The delivery rollers 306 may be formed of, for example, sponge. A sprocket 320 is fixed to one end of the supporting shaft 318 and is drivingly connected to a sprocket portion 326*a* of a power transmission member 324 fixed to one end portion of the rotating shaft 312 via a chain 322. A sprocket portion 326*b* of the power transmission member 324 is drivingly connected to a driving source (not shown) such as an electric motor via a chain 328. Thus, the driving power from the driving source (not shown) is transmitted to the delivery rollers 306 via chain 328, the power transmission member 324, the chain 322, the sprocket 320, and shaft 318 and the delivery rollers 306 rotate in the direction of an arrow 330 (FIG. 13).

The actuating mechanism 308 includes a first actuating means and a second actuating means for moving the delivery roller 306 as is desired, and the first and second actuating means are respectively composed of electromagnetic solenoids 332 and 334. In the modified embodiment, as will be stated below, the electromagnetic solenoids 332 and 334 are disposed in relation to the oscillating supporting member 314 mounted on one end portion of the rotating shaft 312, but they may be disposed in relation to both the oscillating supporting members 314 and 316. The electromagnetic solenoids 332 and 334, substantially as in the embodiment shown in FIGS. 1 to 12, maintain the pair of delivery rollers 306 selectively in an inoperative state in which they are apart from the copying paper on the paper receiving stand 304, in a first operating state in which they act relatively weakly on the copying paper on the paper receiving stand 304, and in a second operating state in which they act relatively strongly on the copying paper received on the paper receiving stand. More specifically, a vertically extending elongate hole 336 is formed in the rear end portion of the oscillating supporting member 314, and a linking member 338 is provided through the elongate hole 336. The linking member 338 is adapted to move freely within and along the elongate hole 336. An output member 340 of the electromagnetic solenoid 332 constituting the first actuating means is connected to one end portion of a linking member 338, and the output member 342 of the electromagnetic solenoid 334 constituting the second actuating means is connected to the other end portion of the linking member 338. A spring member 344 is provided between the electromagnetic solenoid 332 and the one end of the linking member 338 and a spring member 346 is interposed between the electromagnetic solenoid 334 and the other end portion of the linking member 338. The width of the elongate hole 336 is slightly larger than the outside diameter of the linking member 338 so as to permit the oscillating movement of the linking member 338 which will be described below. Thus, when the electromagnetic solenoids 332 and 334 are in the inoperative state, the linking member 338 is positioned in the middle portion of the elongate hole 336 in the longitudinal direction (the vertical direction) (as shown in FIG. 13). Hence, the oscillating supporting member 314 is rotated counterclockwise as shown in FIG. 13 about the rotating shaft 312 as a center by the weights of the delivery rollers 306, the supporting shaft 318. etc. The delivery rollers 306 abut against the upper surface of the paper receiving stand 304 (the upper surface of a copying paper sheet on the receiving stand 304 when present) and presses it relatively weakly (assumes the first operating state shown by solid lines in FIGS. 14 and 15). When the electromagnetic solenoid 332 is actuated in the aforesaid state, the linking member 338 is moved downwardly against the force of the spring member 344, and abuts against the lower end of the elongate hole 336 to pivot the oscillating supporting member 314 clockwise in FIG. 13 about the rotating shaft 312 as a center (at this time, the other oscillating supporting member 316 is also rotated). As a result, the delivery rollers 306 move away upwardly from the paper receiving stand 304 (from a copying paper on the receiving stand 304 when present) (assumes the inoperative state shown by two-dot chain lines in FIG. 14). When the electromagnetic solenoid 334 is actuated in the aforesaid state, the linking member 338 is moved upwardly against the force of the spring member 346 and abuts against the upper end of the elongate hole 336 to pivot the oscillating supporting member 314 counterclockwise as shown in FIG. 13 about the rotating shaft 312 as a center. At this time, the delivery roller 306 abuts against the upper surface of the paper receiving stand 304 (the upper surface of copying paper on the receiving stand 304 when present), and therefore, the force acting on the oscillating supporting member 314 via the linking member 338 by the action of the electromagnetic solenoid 334 is transmitted to the delivery rollers 306, and the delivery rollers 306 are pressed relatively strongly against the upper surface of the receiving stand 304 by the magnetic attracting force of the electromagnetic solenoid 334 which tends to attract the output terminal 342 electromagnetically (assume the state shown by two-dot chain lines in FIG. 15).

Now, with reference to FIGS. 14 and 15, the paper movement hampering means 310 will be described. The illustrated movement hampering means 310 has a plate-like movement hampering member 348 disposed on the forward end portion of the receiving stand 304. The lower end portion of the movement hampering member 348 is fixed to an output member 352 of an electromagnetic solenoid 350 disposed below the receiving stand 304. A spring member 354 is interposed between the electromagnetic solenoid 350 and the movement hampering member 348. The movement hampering member 348 is held at a hampering position (the position shown in FIGS. 14 and 15) at which its upper end portion projects upwardly through an opening 356 formed in the receiving stand 304 by the action of the spring member 354 when the electromagnetic solenoid 350 is inoperative, and at a receding position at which its upper end portion has receded from the upper surface of the receiving stand 304 when the electromagnetic solenoid 350 is actuated.

In this modified embodiment, the electromagnetic solenoids 332, 334 and 350 are inoperative when a copying paper sheet having an image formed on one surface is received on the paper receiving stand 304. Therefore, the delivery rollers 306 are maintained at the aforesaid first operating state (the state shown by solid lines in FIGS. 14 and 15) and act relatively weakly on the paper sheet received on the receiving stand 304. Furthermore, the movement hampering member 348 is held at the hampering position and the movement of the copying paper sheet is hampered upon abutment of its leading edge against the hampering member 348. The electromagnetic solenoid 332 is actuated (the electromagnetic solenoids 332 and 350 are inoperative) when the widthwise position of the paper sheet received on the receiving stand 304 is adjusted. As a result, the delivery rollers 306 are maintained in the inoperative state and move away upwardly from the paper sheet on the receiving stand 304. In delivering the copying paper sheet received on the receiving stand 304, the electromagnetic solenoids 334 and 350 are actuated (at which time the electromagnetic solenoid 322 is inoperative). When the electromagnetic solenoid 350 is actuated, the movement hampering member 348 is held at the receding position, and the copying paper sheet on the receiving stand 304 is ready for delivery. When the electromagnetic solenoid 334 is actuated, the delivery rollers 306 are maintained in the second operating state and act relatively strongly on the copying paper sheet present on the receiving stand 304, and thus exactly deliver the paper sheet from the receiving stand 304 as they rotate in the direction shown by the arrow 330 (FIG. 13). Accordingly, in this modified embodiment, too, substantially the same effect as in the embodiment shown in FIGS. 1 to 12 can be achieved.

In the modified embodiment, there is used a preventing mechanism comprised of a pair of rollers 358 and 360 in order to prevent feeding of copying paper sheets in the superposed state (FIGS. 14 and 15). The pair of rollers 358 and 360 are disposed downstream of the receiving stand 304 in the paper conveying direction. The roller 358 located above acts as a conveying roller which rotates in the conveying direction of the copying paper as shown by an arrow 364 and conveys it toward a paper conveying passage (not shown). The roller 360 below acts as a separating roller which rotates in a direction opposite to the paper conveying direction as shown by an arrow 366 and prevents feeding of two paper sheets at a time in the superposed state. The roller 360 is kept in contact with the roller 358 through an opening (not shown) formed in the receiving stand 304. It is critical that in the preventing mechanism, the roller 358 located above should have a larger coefficient of friction than the roller 360 located below. Preferably, the roller 358 is formed of, for example, rubber, and the roller 360, of rubber, sponge, etc.

Other modified embodiments

In the embodiment shown in FIGS. 1 to 12, the arrival of paper at the paper receiving stand 122 is detected by using the paper detecting mechanism 282 including follower roller 284 which rolls under the action of the moving paper and the detecting means 286 for detecting the rolling of the follower roller 284. Alternatively, the arrival of paper at the paper receiving stand can also be effectively detected by mechanisms shown in FIGS. 16 to 18 or FIG. 19.

Figure 16:
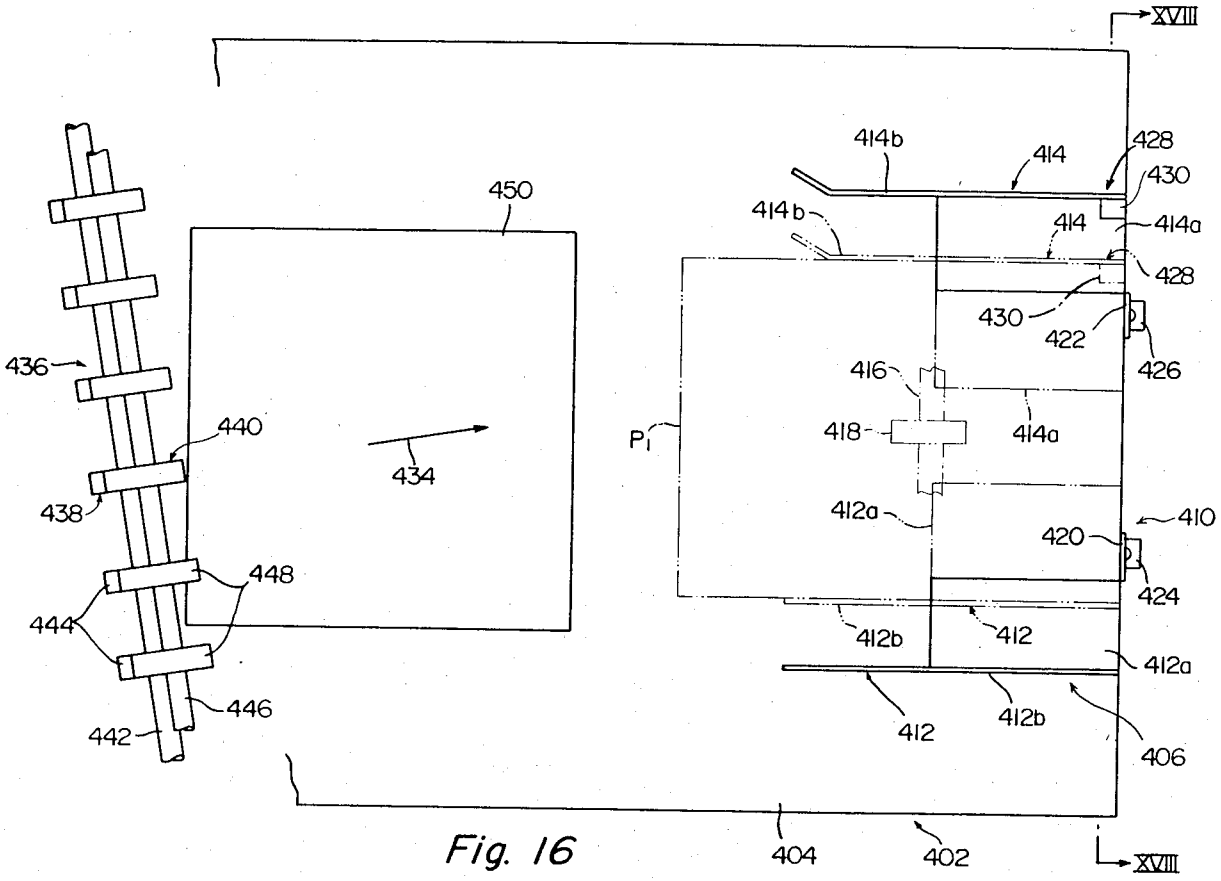
FIG. 16 is a top plan view showing a copying paper re-sending means and its vicinity in a modified example of the electrostatic copying apparatus constructed in accordance with this invention.
Figure 17:
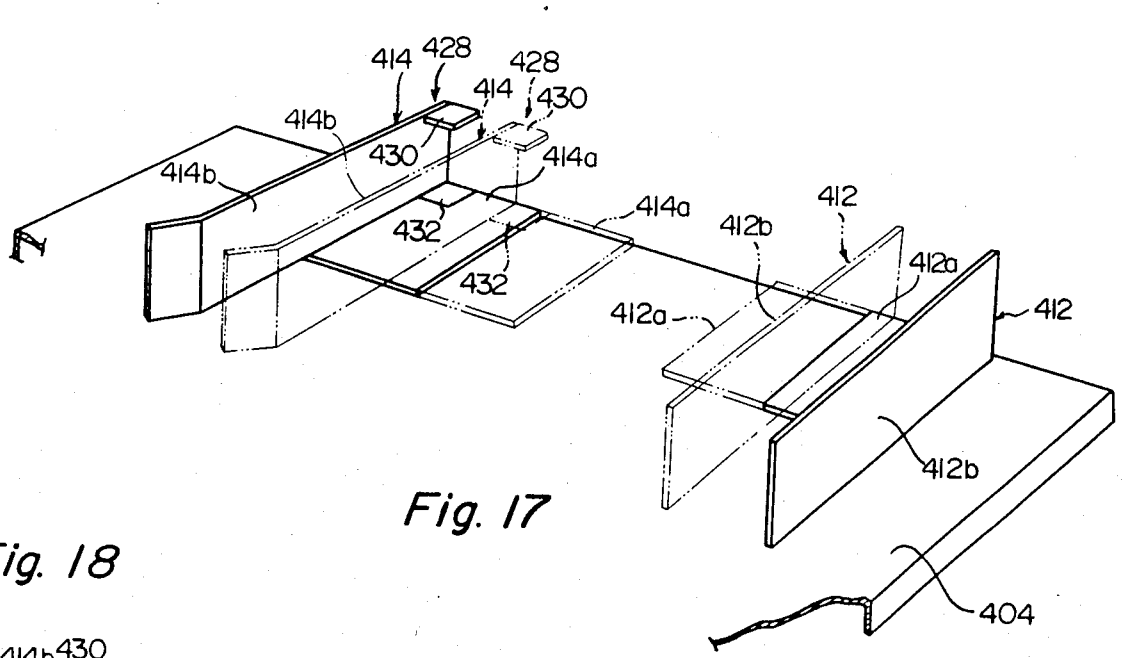
FIG. 17 is a perspective view showing the front part of a copying paper receiving stand of the paper re-sending means of FIG. 16.
Figure 18:
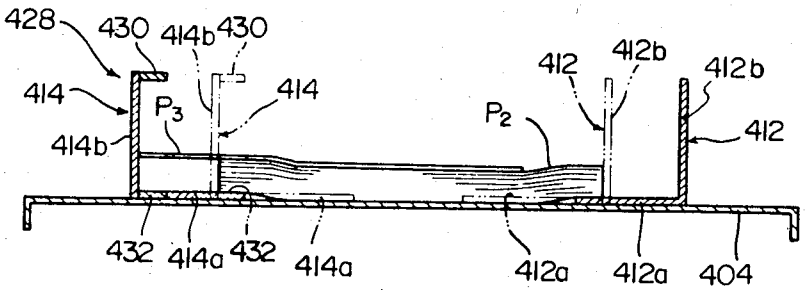
FIG. 18 is a sectional view taken along line XVIII—XVIII of FIG. 16.

With reference to FIGS. 16 to 18, mainly with reference to FIG. 16 which shows the essential parts of the paper re-sending means, the illustrated paper re-sending means 402 is provided with a copying paper receiving stand 404 for receiving copying paper, a width matching means 406 for matching the widthwise positions of copying paper sheets received on the receiving stand 404, a delivery means disposed above the receiving stand 404, an actuating mechanism (not shown) for moving the delivery means in the desired manner, and a copying paper movement hampering means 410 for hampering the movement of copying paper. The paper receiving stand 404 is made up of a plate-like member, and the width matching means 406 is provided in the front part of the receiving stand 404. The illustrated width matching means 406 is composed of a pair of spaced movable matching members 412 and 414 which are mounted on the receiving stand 404 so that they can move in the forward-backward direction (vertically in FIG. 16, and in the left-right direction in FIGS. 17 and 18), and therefore in the widthwise direction of the copying paper received on the receiving stand 404. Specifically, the movable matching members 412 and 414 are mounted for free movement between an outwardly located receiving position (the position shown by solid lines in FIGS. 16 to 18) and an inwardly located matching position (the position shown by a two-dot chain line in FIGS. 16 to 18), and are constructed such that their receiving and matching positions are properly changed according to the size of the copying paper sheet received on the receiving stand 404. The movable matching members 412 and 414 respectively have base portions 412*a* and 414*a* contacting the upper surface of the receiving stand 404 and matching portions 412*b* and 414*b* extending upwardly substantially perpendicularly from the outside ends of the base portions 412*a* and 414*a*. In the modified embodiment, the matching portions 412*b* and 414*b* of the movable matching members 412 and 414 respectively extend rearwardly (to the left in FIG. 16) from the forward ends of the base portions 412*a* and 414*a* beyond their rear ends as shown in FIGS. 16 and 17, and the rear end portion of the matching portion 414*b* of the movable matching member 414 is curved outwardly. The delivery means is comprised of a delivery roller 418 mounted on a supporting shaft 416. As in the embodiment shown in FIGS. 1 to 12 or the modified embodiment shown in FIGS. 13 to 15, the delivery roller 418 is selectively maintained by the action of the actuating mechanism (not shown) in an inoperative state in which it is apart from the copying paper received on the receiving stand 404, a first operating state in which it acts relatively weakly on the copying paper received on the receiving stand 404 and a second operating state in which it acts relatively strongly on the copying paper received on the receiving stand 404. The movement hampering means 410 includes a pair of movement hampering members 420 and 422 spaced from each other in the forward-backward direction (the widthwise direction of the copying paper placed on the receiving stand 404) at the forward end of the receiving stand 404. The lower end portions of the movement hampering members 420 and 422 are fixed respectively to output members of electromagnetic solenoids 424 and 426. The movement hampering members 420 and 422 are held at a hampering position at which their upper end portions projects upwardly from the upper surface of the receiving stand 404 by the action of spring members (not shown) when the electromagnetic solenoids 424 and 426 are inoperative. When the electromagnetic solenoids 424 and 426 are actuated, these movement hampering members are held at a non-hampering position at which their upper ends have receded from the upper surface of the receiving stand 404.

The copying paper re-sending means 402 further includes a copying paper detecting means 428. With reference to FIGS. 16 to 18, the illustrated copying paper detecting means 428 is comprised of a combination of a light emitting element 430 for projecting light and a light receiving element 432 for receiving light. It is critical that the paper detecting means 428 should be provided on the movable matching members movable between the receiving position and the matching position, and on the present modified embodiment, it is disposed in the movable matching member 414. As shown in FIGS. 17 and 18, the light emitting element 430 is fixed to the upper end of the matching portion 414*b* of the movable matching member 414, and the light receiving member 432 is fixed to the outside end of the base portion 414*a* of the movable matching member 414. Hence, the light emitting element 430 and the light receiving element 432 are vertically aligned, so the light from the light emitting element 430 is adapted to be projected onto the light receiving element 432. Preferably, the paper detecting means 428 is disposed between the delivery roller 418 and the movement hampering means 410 as viewed in the paper conveying direction. More preferably, as shown in the modified embodiment, it is provided immediately before the movement hampering means 410 as viewed in the paper conveying direction (in the modified embodiment, the light emitting element 430 is fixed to the front end of the matching portion 414*b* and the light receiving element 432 is fixed to the front end of the base portion 414*a* as shown in FIGS. 16 and 17).

Again with reference to FIG. 16, a copying paper returning means defining a copying paper returning passage is provided upstream of the paper re-sending means 402 as viewed in the paper conveying direction. The paper returning means includes a deflecting-conveying means 436 disposed in the downstream end portion of the paper returning passage as viewed in the paper conveying direction. The illustrated deflecting-conveying means 436 is comprised of a pair of deflecting-conveying rollers 438 and 440. The deflecting-conveying roller 438 located below has a revolving shaft 442 to be revolved in the paper conveying direction and a plurality of axially spaced cylindrical rollers 444 mounted on the revolving shaft 442. The deflecting-conveying roller 440 located above has a rotatably mounted follower shaft 446 and a plurality of axially spaced rollers 448 mounted on the follower shaft 446 correspondingly to the rollers 444. The axes of the pair of deflecting-conveying rollers 438 and 440 are slightly inclined transversely toward the movable matching member 414 in which the paper detecting means 428 is provided. Specifically, the rotating shaft 442 (and therefore the rollers 444) and the follower shaft 446 (therefore the rollers 448) are slightly inclined transversely toward the movable matching member 414 so that as viewed in the paper conveying direction shown by an arrow 434, the forward end portions of the rotating shaft 442 and the follower shaft 446 are located more upstream than their rear end portions. The pair of deflecting-conveying rollers 438 and 440 nip the copying paper and convey it downstream toward the receiving stand 404, and may be used in place of the pair of returning rollers 118 used in the embodiment shown in FIGS. 1 to 12. A guide plate 450 is provided downstream of the pair of deflecting-conveying rollers 438 and 440 as viewed in the paper conveying direction. The guide plate 450 corresponds to the guide plate 119 in the embodiment shown in FIGS. 1 to 12.

The structures of the other parts of the electrostatic copying apparatus in the modified embodiment including the paper re-sending means 402 and the deflecting-conveying means 436 described above are substantially the same as in the electrostatic copying apparatus shown in FIGS. 1 to 12.

In the electrostatic copying apparatus in this modified embodiment, a copying paper sheet having an image formed on one surface is conducted to the paper receiving stand 404 through the paper returning passage. While the copying paper sheet is conveyed by being nipped between the deflecting-conveying rollers 438 and 440, the copying paper sheet is deflected by the action of the deflecting-conveying rollers 438 and 440 in the direction of the arrow 434 (FIG. 16), and therefore in a direction substantially perpendicular to the axes of the deflecting-conveying rollers 438 and 440 because the axes of these rollers 438 and 440 are slightly inclined transversely toward the movable matching member 414. The copying paper introduced into the receiving stand 404 via the upper surface of the guidge plate 450 by the action of the deflecting-conveying rollers 438 and 440 is conveyed downstream by the action of the delivery roller 418, and its movement is stopped when it abuts against the movement hampering members 420 and 422 held at the hampering position. When the copying paper is received on the receiving stand 404, the pair of movable matching members 412 and 414 are held at the receiving positions shown by solid lines in FIGS. 16 to 18, and therefore, the copying paper is accurately received on the receiving stand 404. It will be appreciated from FIG. 18 that when the copying paper has been received as described above, one side edge of the copying paper (the upper side edge in FIG. 16) abuts against the inside surface of the matching portion 414*b* of the movable matching member 414 held in the receiving position because the paper is deflected during passage as stated above. Thus, when the copying paper is moved and its leading end portion is conveyed to the movement hampering members 420 and 422, one side end part of the copying paper is positioned between the light emitting element 430 and the light receiving element 432 as can be seen from FIG. 18. The light from the light emitting element 430 is shielded by this copying paper, and the paper detecting means 428 detects the fact that the copying paper has been received on the receiving stand 404 via the paper returning passage. When the paper has been so received, the movable matching members 412 and 414 are moved in the desired manner (at this time, the delivery roller 418 is kept in the inoperative state). Specifically, the movable matching members 412 and 414 are moved from the receiving positions to the matching positions shown by two-dot chain lines in FIGS. 16 to 18, and then back to the receiving positions. When the movable matching members 412 and 414 are held at the matching positions, the inside surfaces of the matching portions 412*b* and 414*b* act on both side edges of the copying paper on the receiving stand 404 to set the copying paper at a position shown by two-dot chain lines $P_1$ in FIG. 16. When the matching members 412 and 414 are then moved to the receiving positions, they recede from the copying paper, and the receiving stand 404 is ready for receiving the next copying paper. When the widthwise positioning of the copying paper has been terminated in this manner, no copying paper exists between the light emitting element 430 and the light receiving element 432 of the paper detecting means 428, and the paper detecting means 428 is ready for detecting the arrival of the next copying paper.

In receiving a plurality of copying paper sheets on the paper receiving stand 404, one sheet is received on the receiving stand 404 and then the next sheet is received in the stacked state on the preceding sheet. When the next sheet is conveyed likewise to the movement hampering members 420 and 422 by the action of the deflecting-conveying rollers 438 and 440, one side end portion of the next sheet is located between the light emitting element 430 and the light receiving element 432 as stated above, and the paper detecting means 428 detects the fact that the next sheet has been properly conveyed.

Accordingly, in the electrostatic copying apparatus in the present modified embodiment, when the next copying paper $P_3$ is received on the copying paper $P_2$ present on the receiving stand 404 in the stacked state, the copying paper $P_3$ is deflected to the side of the movable matching member 414 by the action of the deflecting-conveying rollers 438 and 440, as shown in FIG. 18. Hence, despite the fact that the copying paper sheets are received in the stacked state on the receiving stand 404, the arrival of copying paper can be exactly detected. It will be easily understood from FIGS. 16 and 18 that by providing the paper detecting means 428 in the movable matching member 414, it is also possible to detect whether the widthwise positioning of the copying paper has been carried out in the desired manner (in other words, when the widthwise positioning of the copying paper is not carried out in the desired manner, the paper detecting means 428 detects the copying paper also when it is moved from the matching position to the receiving position).

In the modified embodiment shown in the drawings, the copying paper is adapted to be deflected rearwardly in the forward-backward direction by the action of the deflecting-conveying rollers 438 and 440. It is also possible to construct the apparatus such that the copying paper is deflected forwardly in the forward-backward direction. This can be achieved by providing the paper detecting means 428 in the movable matching member 412 and by inclining the axes of the deflecting-conveying rollers 438 and 440 constituting the deflecting-conveying means by a predetermined angle in the direction of the movable matching member 412.

Furthermore, in the modified embodiment, the cylindrical deflecting rollers 444 and 448 are used, and the axes of the deflecting-conveying rollers 438 and 440 are inclined in a predetermined direction. Alternatively, the deflecting-conveying rollers 438 and 440 may be made of rollers having a predetermined conical shape without inclining their axes (namely, by providing these rollers 438 and 440 such that their axes are substantially perpendicular to the paper conveying direction). In this case, the copying paper is moved while being deflected to the small-diameter portion of the conical rollers.

In the modified embodiment shown in FIGS. 16 to 18, the deflecting-conveying means 436 is comprised of the pair of deflecting-conveying rollers 438 and 440. Alternatively, it may be made up of a single deflecting-conveying roller as shown in FIG. 19.

Figure 19:
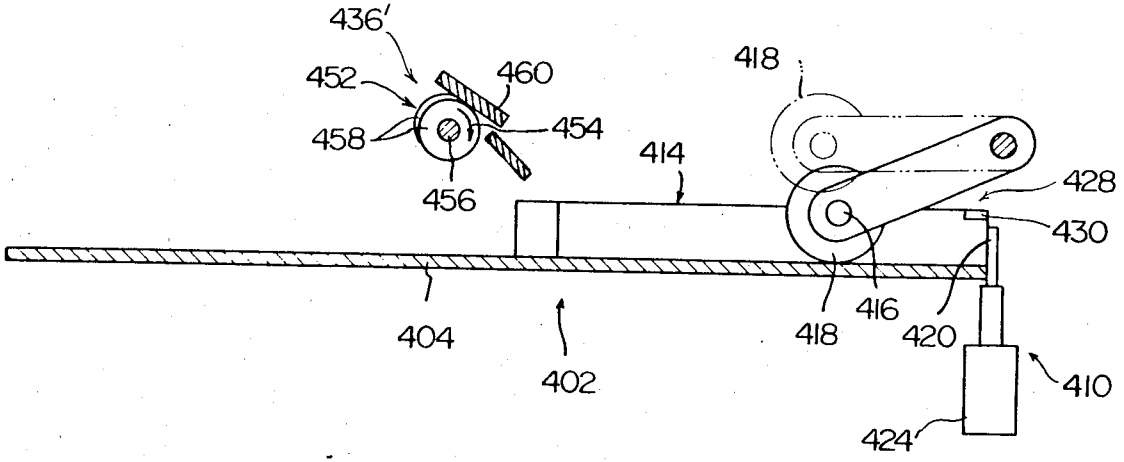
FIG. 19 is a side elevation, partly in section, of a copying paper re-sending means and its vicinity of an electrostatic copying apparatus equipped with a modified example of a deflecting-conveying means.

With reference to FIG. 19, the deflecting-conveying means 436' shown in the drawing is comprised of a deflecting-conveying roller 452 disposed in the downstream end portion of the copying paper returning passage. It is to be noted that in FIG. 19, the same parts as shown in FIGS. 16 to 18 are indicated by the same reference numerals. The deflecting-conveying roller 452 has a revolving shaft 456 to be revolved in the paper conveying direction shown by an arrow 454 and cylindrical deflecting rollers 458 mounted on the revolving shaft 456 at axially spaced intervals. The axis of the deflecting-conveying roller 452 is slightly inclined transversely toward the movable matching member 414 in which the paper detecting means 428 is provided as in the modified embodiment shown in FIGS. 16 to 18. Preferably, the deflection rollers 458 are formed of a relatively flexible material such as sponge. When the deflecting-conveying means 436' is constructed of the single deflecting-conveying roller 452, the copying paper is conveyed over the upper side of the deflecting-conveying roller 452, and preferably, as shown in FIG. 19, a guide member 460 is provided over, and in relation to, the deflecting-conveying roller 452. More specifically, it is preferred that the upper portion of the deflection rollers 458 be in press contact with the under surface of the guide member 460 provided opposite to the deflection rollers 458. In this case, the copying paper is conveyed between the deflecting-conveying roller 452 and the guide member 460.

When the deflecting-conveying means 436' is used, the copying paper is nipped between the deflection rollers 458 of the deflection-conveying roller 452 and the guide member 460 and moved toward the receiving stand 404 by the revolving of the deflection roller 458 in the direction shown by the arrow 454. During movement of the copying paper by the deflection rollers 458, the copying paper is moved downstream while being deflected rearwardly in the forward-backward direction under the action of the deflection rollers 458 since the axis of the deflecting-conveying roller 452, and therefore, the axes of the deflection rollers 458, are inclined in the direction of the movable matching member 414. Furthermore, since the deflection rollers 458 are pressed against the guide member 460, the copying paper is accurately moved by the cooperative action of the deflection rollers 458 and the guide member 460. Thus, in the case of using the deflecting-conveying means 436' described above, too, the same result as in the modified embodiment shown in FIGS. 16 to 18 is achieved.

Incidentally, when the copying paper re-sending means 402 further includes a forwardly actuating roller for moving the copying paper toward the movement hampering members 420 and 422 (in which case a delivery roller for delivering the copying paper from the receiving stand 404 is separately provided above the receiving stand 404), it is possible to incline the axis of the forwardly actuating roller in a predetermined direction instead of inclining the deflecting-conveying roller. In this embodiment, the forwardly actuating roller acts as the deflecting-conveying means.

What is claimed is:

1. An electrostatic copying apparatus adapted to introduce selectively a copying paper sheet having an image formed on one surface thereof during conveyance through a copying paper conveying passage into a copying paper returning passage, return the copying paper sheet through the paper returning passage to a copying paper re-sending means disposed below the paper returning passage, and to feed it again to the paper conveying passage from the re-sending means in order to form an image on the other surface, said re-sending means including a copying paper receiving stand for receiving copying paper sheets having an image formed on one surface in the stacked state, a width matching means for matching the widthwise positions of the copying paper sheets received on the paper receiving stand, and a delivery means disposed above the paper receiving stand; wherein said paper re-sending means further includes an actuating mechanism for maintaining said delivery means selectively in a non-operating state in which it is kept apart from a copying paper sheet received on the paper receiving stand, in a first operating state in which it acts relatively weakly on said copying paper sheet, and in a second operating state in which it acts relatively strongly on said copying paper sheet, and said actuating mechanism maintains the delivery means in the first operating state when the copying paper sheet having an image formed on one surface is received on the paper receiving stand through the returning passage, in the non-operating state when the widthwise positions of the copying paper sheets received on the receiving stand are matched by the action of the width matching means, and in the second operating state when the copying paper sheet received on the paper receiving stand is delivered toward the paper conveying passage.

2. The apparatus of claim 1 wherein the actuating mechanism includes a first and a second actuating means, and maintains the delivery means in the first operating state when both the first and second actuating means are in the non-operating state, in the non-operating state when the first actuating means is in the operating state and the second actuating means is in the non-operating state, and in the second operating state when the first actuating means is in the non-operating state and the second actuating means is in the operating state.

3. The apparatus of claim 2 wherein the actuating mechanism includes an oscillating supporting member mounted for oscillation and having an elongate hole formed at its rear end portion with a linking member being inserted into the elongate hole movably therealong; the first and second actuating means are composed of electromagnetic solenoids the output terminals of which are connected to the linking member; and the delivery means is composed of a delivery roller mounted on the forward end portion of the oscillating supporting member for rotation in a predetermined direction.

4. The apparatus of claim 3 wherein when the first and second actuating means are both in the non-operating state, the linking member is located in the middle of the elongate hole of the oscillating supporting member and thus the delivery roller acts on the copying paper sheet received in the paper receiving stand by its own weight and presses it relatively weakly; when the first actuating means is in the operating state and the second actuating means is in the non-operating state, the linking member abuts against one end of the elongate hole and acts on the oscillating supporting member, and thus the delivery roller moves upwardly away from the copying paper sheet on the paper receiving stand by the action of the first actuating means; and when the first actuating means is in the non-operating state and the second actuating means is in the operating state, the linking member abuts against the other end of the elongate hole and acts on the oscillating supporting member and thus the delivery roller acts on, and relatively strongly presses, the copying paper sheet on the paper receiving stand by the action of the second actuating means.

5. The apparatus of claim 1 wherein the paper re-sending means further includes means for preventing feeding of copying paper sheets in the superposed state, and the preventing means is comprised of a pair of rollers disposed downstream of the paper receiving stand in the paper conveying direction; and one of the pair of rollers is rotated in the paper conveying direction and acts as a conveying roller and the other is rotated in a direction opposite to the paper conveying direction and acts as a separation roller.

6. The apparatus of claim 1 wherein the paper re-sending means includes a copying paper movement hampering means disposed on the forward end portion of the paper receiving stand, and the movement hampering means is selectively held at a hampering position at which it acts on the copying paper sheet received on the paper receiving stand and a receding position at which it has receded from the copying paper sheet received on the paper receiving stand.

7. The apparatus of claim 6 wherein the actuating mechanism moves the delivery means and the movement hampering means; the actuating mechanism maintains the delivery means in the first operating state, and holds the movement hampering means at the hampering position, when a copying paper sheet having an image formed on one surface is received on the paper receiving stand via the paper returning passage; the actuating mechanism holds the movement hampering means at the hampering position and maintains the delivery means in the non-operating state when the widthwise position of the copying paper sheet received on the paper receiving stand is adjusted by the action of the width matching means; and the actuating mechanism maintains the delivery means in the second operating state and holds the movement hampering means at the receding position when the copying paper sheet received on the paper receiving stand is delivered toward the copying paper conveying passage.

8. The apparatus of claim 6 wherein the actuating mechanism includes a first and a second actuating means; the actuating mechanism maintains the delivery means in the first operating state and holds the movement hampering means at the hampering position when the first and second actuating means are both in the non-operating state; the actuating mechanism maintains the delivery means in the non-operating state and holds the movement hampering means at the hampering position when the first actuating means is in the operating state and the second actuating means is in the non-operating state; and the actuating mechanism maintains the delivery means in the second operating state and holds the movement hampering means at the receding position when the first actuating means is in the non-operating state and the second actuating means is in the operating state.

9. The apparatus of claim 8 wherein the actuating mechanism includes a first, a second and a third oscillating members mounted for oxcillation, the delivery means is rotatably mounted on the first oscillating member, and the movement hampering means is mounted on the third oscillating member; when the first and second actuating means are in the non-operating state, the first oscillating member can oscillate and thus the delivery roller acts by its own weight on the copying paper sheet received on the paper receiving stand and presses it relatively weakly; when the first actuating means is actuated, the first oscillating member is pivoted in a predetermined direction and thus the delivery means moves away from the copying paper sheet received on the paper receiving stand and is situated above it; and when the second actuating means is actuated, the third oscillating member is pivoted and the first oscillating member is pivoted in a direction opposite to said predetermined direction incident to the pivoting movement of the third oscillating member transmitted through the second oscillating member, whereby the movement hampering means is moved from the hampering position to the receding position and held there and the delivery means is maintained in the second operating state.

10. The apparatus of claim 9 wherein a spring member is interposed between the first oscillating member and the second oscillating member, and when the second actuating means is actuated, the first oscillating member is pivoted in a direction opposite to said predetermined direction incident to the pivoting movement of the third oscillating member transmitted through the second oscillating member and the spring member, whereby the delivery means elastically acts on, and relatively strongly presses, the copying paper sheet on the paper receiving stand by the action of the spring member.

11. The apparatus of claim 9 wherein the actuating mechanism further includes a pivotably mounted revolving lever one end portion of which is connected to the first actuating means, and the first oscillating member has an abutment portion against which the other end portion of the revolving lever can abut; and when the first actuating means is actuated, the revolving lever is pivoted and the other end portion of the revolving lever acts on the abutment portion to pivot the first oscillating member in said predetermined direction whereby the delivery means moves away from, and is situated above, the sheet-like copying paper received on the paper receiving stand.

12. The apparatus of claim 9 wherein the second actuating means is connected to the third oscillating member and the second oscillating member has an abutment portion against which a part of the third oscillating member can abut; and when the second actuating means is actuated, the third oscillating member is pivoted and said part of the third oscillating member acts on the abutment portion of the second oscillating member whereby the second oscillating member is pivoted incident to the pivoting movement of the third oscillating member.

13. The apparatus of claim 9 wherein a mechanism for preventing feeding of copying papers in the superposed state is disposed downstream of the paper re-sending means as viewed in the paper conveying direction in relation to the paper re-sending means, and the preventing mechanism includes a conveying roller adapted to be revolved in a predetermined direction and a frictional member, and the frictional member is selectively maintained in an operating state at which it acts on the conveying roller and a non-operating state in which it is set apart from the conveying roller.

14. The apparatus of claim 13 wherein the mechanism for preventing feeding of papers in the superposed state further includes an oscillating arm mounted for oscillation and adapted to pivot in relation to the pivoting movement of the third oscillating member, the frictional member is mounted on the oscillating arm, and the frictional member is maintained in the non-operating state when the second actuating means is non-operating, and is maintained in the operating state in relation to the pivoting movement of the third oscillating member when the second actuating means is actuated.

15. The apparatus of claim 14 wherein a pressing spring member is interposed between the oscillating arm and the frictional member, and in said operating state, the frictional member is elastically held in pressing contact with the peripheral surface of the conveying roller.

16. The apparatus of claim 15 wherein a supporting member is mounted on the ocillating arm so that it can move over a predetermined range toward and away from the conveying roller, said pressing spring member is also interposed between the oscillating arm and the supporting member, and the frictional member is mounted on the supporting member.

17. The apparatus of claim 8 wherein the first and second actuating means are comprised of electromagnetic solenoids.

18. The apparatus of claim 7 wherein the movement hampering means is free to pivot between the hampering position and the receding position, and projects upwardly from the upper surface of the paper receiving stand when it is at the hampering position, and is away from the upper surface of the paper receiving stand when it is at the receding position.

19. An electrostatic copying apparatus comprising a copying paper conveying means defining a copying paper conveying passage, a copying paper feeding means for feeding a copying paper sheet to the paper conveying passage, a copying paper returning means defining a copying paper returning passage, a copying paper re-feeding means defining a copying paper re-feeding passage, and a copying paper re-sending means for receiving a copying paper sheet returned through the paper returning passage and re-sending it to the paper conveying message through the paper re-feeding passage, said apparatus being adapted to feed a copying paper sheet to the paper conveying passage from the paper feeding means, convey it through the paper conveying passage to form an image on one surface of the sheet during conveyance through the conveying passage, selectively introduce the copying paper sheet having an image formed on one surface into the paper returning passage, return the copying paper sheet through the paper returning passage to the paper re-sending means, re-feed the copying paper sheet through the paper re-feeding passage from the paper re-sending means to the paper conveying passage, and re-convey the copying paper sheet through the paper conveying passage to form an image on its other surface during the re-conveyance; wherein the paper re-sending means includes a copying paper receiving stand for receiving in the stacked state copying paper sheets returned through the paper returning passage, a width matching means for matching the widthwise positions of the copying paper sheets received on the paper receiving stand, and a copying paper detecting means for detecting the copying paper sheet, the width matching means includes at least one movable matching member movable between a receiving position at which the copying papers are received and a matching position at which the widthwise positions of the copying paper sheets are matched, the copying paper detecting means is mounted on the movable matching member, and the paper returning means further includes a deflecting-conveying means for conveying in the deflected state the copying paper sheet, which is to be returned toward the paper-re-sending means, toward the movable matching member on which the paper detecting means is mounted.

20. The apparatus of claim 19 wherein the width matching means has a pair of movable matching members spaced from each other, and each of the pair of movable matching members is free to move in the widthwise direction of the copying paper sheet is received on the paper receiving stand between the receiving position and the matching position.

21. The apparatus of claim 19 wherein the deflecting-conveying means is comprised of a pair of deflecting-conveying rollers disposed in the downstream end portion of the paper returning passage in the paper conveying direction; the axis of each of the pair of deflecting-conveying roller is inclined transversely toward the movable matching member on which the paper detecting means is mounted; and the copying paper sheet returned toward the paper re-sending means through the paper returning passage is nipped between the pair of deflecting-conveying rollers and is conveyed by the action of the pair of deflecting-conveying rollers while being deflected toward the movable matching member on which the paper detecting means is mounted.

22. The apparatus of claim 19 wherein the deflecting-conveying means is comprised of a deflecting-conveying roller disposed in the downstream end portion of the paper returning passage in the paper conveying direction; the axis of the deflecting-conveying roller is inclined transversely toward the movable matching member on which the paper detecting means is mounted; and the copying paper sheet returned toward the paper re-sending means through the paper returning passage is conveyed over the deflecting-conveying roller and, under the action of the deflecting-conveying roller, is deflected toward the movable matching member on which the paper detecting means is mounted during conveyance.

23. A mechanism for preventing feeding of copying paper sheets in the superposed state, said mechanism comprising:

a conveying roller having a peripheral surface and mounted for rotation in a predetermined feeding direction;

a frictional member; and pressing mechanism means for selectively moving said frictional member between an operating state in which it acts on said peripheral surface of said conveying roller and a non-operating state in which it is spaced from said peripheral surface of said conveying roller, said pressing mechanism including an oscillating arm supporting said frictional member, said oscillating arm being mounted for oscillating movement between a first position at which it maintains said frictional member in said operating state and a second position at which it maintains said frictional member in said non-operating state, a supporting member mounted on said oscillating arm for movement relative thereto over a predetermined range toward and away from said conveying roller, said frictional member being mounted on said supporting member, and pressing spring member means interposed between said oscillating arm and said supporting member for, when said frictional member is in said operating state, elastically maintaining said frictional member in pressing contact with said peripheral surface of said conveying roller.

24. The mechanism of claim 23 wherein a copying paper re-sending means for receiving a copying paper sheet having an image formed on one surface as a result of having been conveyed through a copying paper conveying passage and again feeding the received paper sheet into the conveying passage is provided upstream of the conveying roller and the frictional member in the paper conveying direction; the paper re-sending means comprises a copying paper receiving stand for receiving copying paper sheets in the stacked state, a delivery means disposed above the paper receiving stand and a movement hampering means adapted to be movable between a hampering position at which it acts on a copying paper sheet received on the paper receiving stand and a receding position at which it has receded from the paper sheet on the paper receiving stand; and the oscillating arm is pivoted in relation to the movement of the movement hampering means, is held at the second position when the movement hampering means is at the hampering position, and is held at the first position when the movement hampering means is at the receding position.

25. A mechanism for detecting the feeding of a copying paper sheet by a feeding means onto a copying paper receiving stand adapted to receive thereon a plurality of copying paper sheets in a stacked state, said mechanism comprising:

a supporting member mounted above the copying paper receiving stand for movement vertically relative thereto;

a follower roller rotatably mounted on said supporting member at a position to contact the top of a copying paper sheet being fed onto the copying paper receiving stand by the feeding means and to be rotated solely by the movement of the thus fed copying paper sheet, the rotation of said follower roller being mechanically isolated from and independent of the operation of the feeding means; and detecting means for detecting said rotation of said follower roller.

26. The mechanism of claim 25 wherein the feeding means comprises a feed roller mounted rotatably on said supporting member and adapted to rotate in a predetermined direction.

27. The mechanism of claim 26 wherein the detecting means is disposed in relation to a copying paper re-sending means for receiving a copying paper sheet having an image formed on one surface as a result of having been conveyed through a copying paper conveying passage and again feeding the received paper sheet into the conveying passage; the paper receiving stand is adapted to receive in the stacked state copying paper sheets having an image formed on one surface; and the feed roller is a delivery roller for delivering a copying paper sheet received on the paper receiving stand toward the paper conveying passage.

28. The mechanism of claim 25 wherein the detecting means is comprised of a combination of a light emitting element and a light receiving element disposed on opposite sides of the follower roller, and the follower roller has formed therein an opening through which the light from the light emitting element can pass.

* * * * *